US008979427B2

(12) United States Patent
Farrell, Jr.

(10) Patent No.: US 8,979,427 B2
(45) Date of Patent: Mar. 17, 2015

(54) COASTAL RECOVERY UTILIZING REPOSITIONABLE SHOAL MODULE

(71) Applicant: Joseph Edward Farrell, Jr., Fort Lauderdale, FL (US)

(72) Inventor: Joseph Edward Farrell, Jr., Fort Lauderdale, FL (US)

( * ) Notice: Subject to any disclaimer, the term of this patent is extended or adjusted under 35 U.S.C. 154(b) by 41 days.

(21) Appl. No.: 13/734,417

(22) Filed: Jan. 4, 2013

(65) Prior Publication Data

US 2014/0193199 A1 Jul. 10, 2014

(51) Int. Cl.
*E02B 8/00* (2006.01)
*E02B 3/04* (2006.01)

(52) U.S. Cl.
CPC .... *E02B 8/00* (2013.01); *E02B 3/04* (2013.01)
USPC ..... 405/16; 405/15; 405/17; 405/21; 405/23; 405/25

(58) Field of Classification Search
CPC ..... E02B 3/04; E02B 3/06; E02B 8/00; A01K 61/006
USPC ..... 405/15, 16, 17, 21, 23, 25, 26, 31, 35, 405/74, 205, 211
See application file for complete search history.

(56) References Cited

U.S. PATENT DOCUMENTS

| | | | | |
|---|---|---|---|---|
| 902,372 | A | 10/1908 | Cameron | |
| 1,287,902 | A | 12/1918 | Cyr | |
| 1,310,461 | A | 7/1919 | Williams | |
| 2,396,226 | A | 3/1946 | Aston | |
| 3,640,075 | A | 2/1972 | La Peyre | |
| 3,969,900 | A | 7/1976 | Plodowski | |
| 4,669,913 | A | 6/1987 | Temple | |
| 4,820,079 | A | 4/1989 | Wheeler | |
| 4,877,349 | A | 10/1989 | Greene | |
| 4,954,012 | A | 9/1990 | Wheeler | |
| 5,074,707 | A | 12/1991 | Greene | |
| 5,113,792 | A * | 5/1992 | Jones et al. | 119/221 |
| 5,129,756 | A * | 7/1992 | Wheeler | 405/23 |
| 5,176,468 | A | 1/1993 | Poole | |
| 5,536,112 | A | 7/1996 | Oertel, II | |
| 5,941,661 | A | 8/1999 | Ishikura | |
| 6,059,491 | A | 5/2000 | Striefel et al. | |
| 6,401,420 | B1 | 6/2002 | Salls | |
| 6,431,792 | B1 | 8/2002 | Barnes | |
| 6,491,473 | B2 | 12/2002 | Veazey | |
| 6,863,473 | B1 | 3/2005 | Tucker | |
| 6,896,445 | B1 | 5/2005 | Engler | |
| 7,052,205 | B2 | 5/2006 | de Andrade | |
| 7,992,509 | B1 * | 8/2011 | Veazey | 114/267 |
| 8,177,457 | B2 * | 5/2012 | Boudreaux, Jr. | 405/114 |
| 2006/0159518 | A1 * | 7/2006 | Cravens | 405/16 |
| 2008/0056823 | A1 | 3/2008 | Farrell, Jr. | |
| 2012/0315090 | A1 | 12/2012 | Farrell, Jr. et al. | |
| 2012/0321388 | A1 | 12/2012 | Farrell, Jr. | |

* cited by examiner

*Primary Examiner* — Benjamin Fiorello
*Assistant Examiner* — Carib Oquendo
(74) *Attorney, Agent, or Firm* — Holland & Knight LLP; Brian J. Colandreo, Esq.; Jeffrey T. Placker, Esq.

(57) ABSTRACT

A coastal recovery module including a body portion defining an interior compartment. The coastal recovery module may also include a selectively sealable fluid conduit. The selectively sealable fluid conduit may provide a fluid communication between the interior compartment and an exterior of the body portion, the fluid conduit configured for selectively flooding and dewatering the interior compartment. The coastal recovery module may further include a wave energy mitigation structure associated with at least a portion of a top surface of the body portion.

6 Claims, 24 Drawing Sheets

COASTAL RECOVERY UTILIZING REPOSITIONABLE SHOAL MODULE

TECHNICAL FIELD

The present disclosure generally relates to the stabilization and/or restoration of beaches, and more particularly relates to stabilization and/or restoration of beaches by diminishing wave energy and/or utilization of longshore transport interactions.

BACKGROUND

Waves, storms, and coastal currents may all result in beach erosion, manifesting in long term losses of sediment and rock, as well as short term redistribution of sediment and rock to other regions of a coastline. Further, such effects may also result in impact to, or loss of, the associated aquatic system. Such beach erosion can damage coastal property, for example, by reducing the size of the beach and undermining coastal structures. Such destruction and losses can have a severe negative impact on beach properties, property values, local and/or regional tourism industry, and the local tax base. Additionally, the loss of beach terrain and aquatic systems may result in the loss of natural eco-habitats for coastal biota. The loss of natural eco-habitats and associated impacts to the biota can have a deleterious impact on coastal eco-environments.

SUMMARY OF THE DISCLOSURE

According to an embodiment, a coastal recovery module may include a body portion defining an interior compartment. The coastal recovery module may also include a selectively sealable fluid conduit providing a fluid communication between the interior compartment and an exterior of the body portion, the fluid conduit configured for selectively flooding and dewatering the interior compartment. The coastal recovery module may also include a wave energy mitigation structure associated with at least a portion of a top surface of the body portion.

One or more of the following features may be included. The wave energy mitigation structure may include a plurality of generally L-shaped members extending from the top surface of the body portion. The plurality of generally L-shaped members may be oriented in a generally parallel configuration. At least a portion of the plurality of generally L-shaped members may be oriented at an angle relative to one another. The wave energy mitigation structure may include an undulating surface having a plurality of undulations. The plurality of undulations may be oriented generally parallel to one another. At least a portion of the plurality of undulations may be oriented at an angle relative to one another.

The wave energy mitigation structure may include a bio-habitat feature. The bio-habitat feature may include a plurality of rocks affixed to the top surface of the body portion. The bio-habitat feature may include one or more of an oyster reef and a coral reef affixed to the top surface of the body portion. The bio-habitat feature may include a bio-mat.

The wave energy mitigation feature may include an aeration system. The aeration system may include one or more aeration manifolds configured to dispense a plurality of air bubbles along a length of the one or more aeration manifolds. The aeration system may include a bellows structure. The bellows structure may be configured to dispense air bubbles via the one or more aeration manifolds in response to wave energy applied to the bellows structure.

The fluid conduit may include an opening adjacent a top of the body portion. A conduit may provide fluid communication between the opening and a portion of the interior compartment adjacent a bottom region of the interior compartment. The coastal recovery module may include a spud receptacle coupled with the body portion. The coastal recovery module may include one or more rib members within the interior compartment.

According to another embodiment, a method of restoring a beach may include providing a recovery module including a body portion defining an interior compartment, and a wave energy mitigation structure associated with at least a portion of a top surface of the body portion. The recovery module may be positioned at a first location in a region relative to a beach to sea interface. A longitudinal axis of the recovery module may be oriented generally perpendicular to a prevailing current. The recovery module may be removed from the first location upon achieving a desired level of accretion relative to the recovery module.

One or more of the following features may be included. The prevailing current may include an onshore current. The desired level of accretion relative to the recovery module may include a desired level of accretion in a near-shore region relative to the recovery module. The desired level of accretion may provide a decreased water depth in the near-shore region relative to the recovery module. The prevailing current may include a longshore current. The desired level of accretion may provide a reduced longshore current interaction at the recovery module.

The method may further include positioning the recovery module at a second location relative to the beach to sea interface. The second location may include at least one of a seaward location relative to the first location and an updrift location relative to the first location. The method may also include positioning the recovery module in a maintenance location.

The details of one or more implementations are set forth in the accompanying drawings and the description below. Other features will become apparent from the description, the drawings, and the claims.

DETAILED DESCRIPTION OF EXEMPLARY EMBODIMENTS

Figure 1:
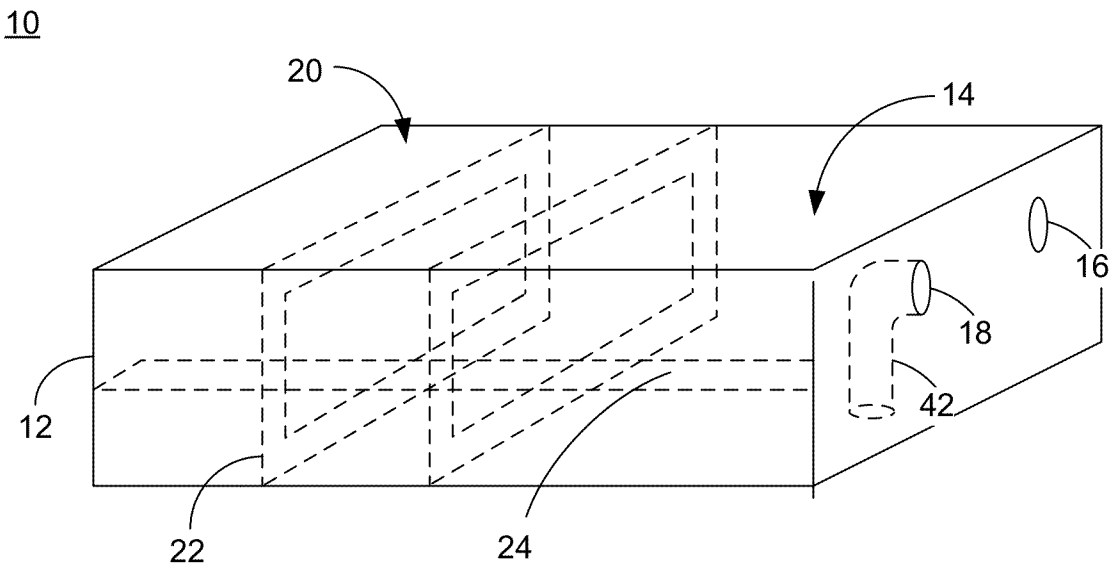
FIG. 1 diagrammatically depicts a general configuration of a coastal recovery module according to an embodiment.

Referring to FIG. 1, coastal recovery module 10 (herein also referred to as a "recovery module") may generally include body portion 12 defining interior compartment 14. In some embodiments, coastal recovery module 10 may include only a single interior compartment. Further, coastal recovery module 10 may include one or more selectively sealable fluid conduits (e.g., fluid conduits 16, 18) providing a fluid communication between interior compartment 14 and an exterior of body portion 12. The fluid conduit (e.g., ports 16, 18) may be configured for selectively flooding and dewatering the interior compartment. Coastal recovery module 10 may also include a wave energy mitigation structure (discussed in greater detail below) associated with at least a portion of top surface 20 of body portion 12. In various embodiments, the wave energy mitigation structure may additionally/alternatively be associated with one or more side surfaces of body portion 12.

In general, recovery module 10 may be configured to mitigate degradation of a coastal region, and/or facilitate recovery or restoration of a coastal region. For example, suspended particulate material may generally be forced up a beach generally in the direction of an onshore current (e.g., waves breaking on the shoreline and/or in a near-shore region). The water may recede from beach region (e.g., as backwash) in a direction that may be generally perpendicular to an interface between the beach and sea (e.g., the backwash may flow along the gradient of the beach) to seaward. Particulate material suspended in the water (e.g., as a result of the onshore wave action) may be carried away from beach region and/or the interface between the beach and the sea interface, either down the coastline along the direction of a longshore current (e.g., which may result in the difference in direction of the swash and the backwash) and/or seaward away from the beach region. In part, recovery module 10 may be implemented to decrease energy imparted by the onshore current in a coastal region to reduce the capacity of the wave action to suspend sediment, such as sand, silt, and other particulate material, in the water. Additionally/alternatively recovery module 10 may be implemented to decrease the transport of suspended sediment, e.g., by reducing the carrying capacity of the longshore current. According to various embodiments, coastal recovery module 10 may be disposed partially, and/or completely, in the water in a coastal environment (e.g., partially on a beach and partially in the water, and/or completely in the water). The presence of coastal recovery module 10 may diminish energy associated with currents (e.g., onshore currents, longshore currents, etc.) in the coastal region. The interactions of coastal recovery module 10 and the coastal environment will be explained in greater detail below.

In some embodiments, recovery module 10 may include a generally rectangular prismic, or box-like, body portion 12. According to one embodiment, recovery module 10 may have dimensional ratios of one unit height, one and a quarter units width, and four units length. For example, in an illustrative embodiment recovery module 10 may have a length of between about 20 feet to about 40 feet. According to another embodiment, recovery module 10 may have dimensional ratios of one unit height, three units width, and six units length. Similarly, in some illustrative embodiments recovery module 10 may have a length of between about 40 feet to about 60 feet. However, these dimensions are intended only for the purpose of illustration, and not of limitation. Various additional/alternative dimensions may suitably be utilized depending upon various factors, such as environmental conditions, design preference, recovery module availability, and the like, which may provide for a variety of alternative implementations. For example, in beach environments having a steeper gradient (e.g., as may be associated with a high energy beach) a relatively shorter recovery module may be employed. Conversely, in beach environments having a shallower gradient a relatively longer recovery module may be employed. However, such implementations should be understood to be for the purpose of example, and not of limitation, as environmental conditions, design preference, recovery module availability, and the like, may provide for a variety of alternative implementations. The illustrated recovery modules herein are intended for the purpose of example and should not be construed as a limitation. Various additional/alternative geometries (e.g., cylindrical, trapezoidal, etc.), dimensions, and dimension ratios may suitable be utilized depending upon environmental conditions, design criteria, etc.

Consistent with various embodiments, recovery module 10 may include body portion 12 that may be manufactured from metal (e.g., reinforced or non-reinforced sheet metal), plastic (including fiber reinforced plastics as well as non-reinforced plastics), composite materials, concrete (reinforced as well as non-reinforced) or other suitable materials. In some embodiments, recovery module 10 may include generally sealed and/or watertight structures defining interior compartment 14, and/or include generally sealed and/or watertight features (e.g., interior compartment 14). Further, an as discussed above, the generally sealed and/or watertight interior compartment 14 may include fluid conduits 16, 18, such as passages, hoses, vents, etc., that may be selectively opened such that the generally sealed and/or watertight interior compartment may be at least partially filled with fluid (such as water or air), for example, to allow flooding of the generally sealed and/or watertight interior compartment 14. Additionally, in some embodiments, when the at generally sealed and/or watertight interior compartment 14 is filled with air, recovery module 10 may be at least partially buoyant and/or floatable. An at least partially buoyant and/or floatable recovery module 10 may facilitate, for example, sea transport, for example by pushing or towing.

In some embodiments, coastal recovery module 10 may include one or more rib members (e.g., rib 22 and/or stringer 24) within interior compartment 14. While the illustrated embodiment depicts two ribs and a single stringer, such depiction is intended only for the purpose of illustration, and not of limitation. The number of ribs and/or stringers within interior compartment 10 and/or body portion 12, as well as the relative dimensions of any ribs and/or stringers may vary depending upon design criteria and need. Rib 22 and/or stringer 24 may, in some embodiments, increase the structural integrity of body portion 12, e.g., which may improve the ability of coastal recovery module 10 to withstand wave impact and the like, without becoming structurally compromised. Additionally/alternatively, in a condition in which interior compartment 14 may be at least partially flooded, rib 22 and/or stringer 24 may reduce relatively rapid movement of water (e.g., "sloshing") within interior compartment. As such, rib 22 and/or stringer 24 may reduce rapid changes in the center of buoyancy of coastal recovery module 10. Various additional/alternative structural features may be included, such as, but not limited to, bulkheads, baffles, double bottoms, doubler plates, gussets, and the like.

Figure 2:
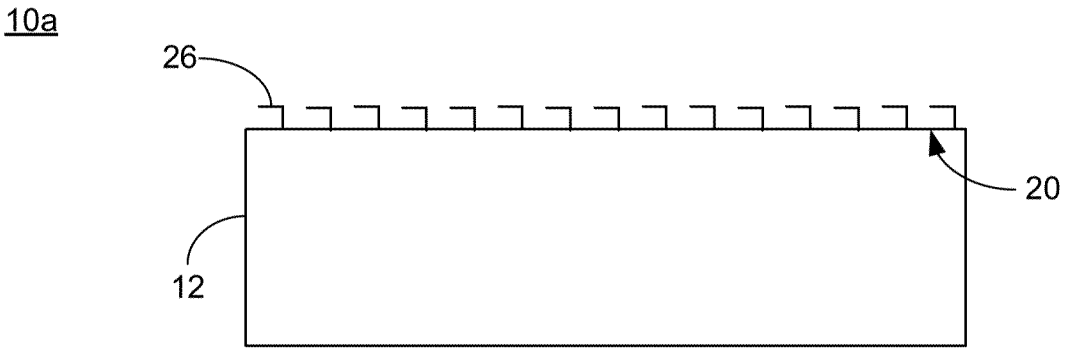
FIG. 2 diagrammatically depicts an embodiment of a coastal recovery module including generally L-shaped wave energy mitigation members.

With reference also to FIG. 2, in an embodiment coastal recovery module 10*a* may include a wave energy mitigation structure including a plurality of generally L-shaped members (e.g., L-shaped member 26) extending from top surface 20 of body portion 12. As shown, one leg L-shaped member 26 may generally extend upwardly from top surface 20 of body portion 12, and the other leg may extend in a direction generally parallel with top surface 20. In such an embodiment, the plurality of L-shaped members may create turbulence in waves passing over, and/or breaking on, coastal recovery module 10*a*, e.g., which may destabilize and/or decrease the energy of the waves. For example, the irregular top surface provided by the plurality of generally L-shaped members may disrupt wave transmission and/or organized hydraulic flow of waves passing coastal recovery module 10*a*. In some embodiments, L-shaped member 26 may include an angle iron structure. While L-shaped member 26 is shown having legs of approximately equal length, such depiction is intended for illustrative purposed only. The relative length of the legs of the L-shaped members may vary depending upon design criteria and need. Similarly, while each of the plurality of generally L-shaped members have been depicted as being generally the same size, this is intended for the purpose of illustration only, as at least a portion of the plurality of generally L-shaped members may have different sized relative to another portion of the plurality of generally L-shaped members. Further, in some embodiment the legs of the L-shaped members may be at an angle other than about 90 degrees. For example, in some embodiments, the angle formed by the legs of the L-shaped members may be in the range of between about 45 degrees and about 135 degrees. Additionally, in some embodiments, the leg of the L-shaped members extending from the top surface of the body portion may extend at an angle other than about 90 degrees. For example, in some embodiments, the leg extending from the top surface of the body portion may extend at an angle of between about 45 degrees to about 135 degrees relative to the top surface of the body portion of coastal recover module 10*a*.

In some embodiments, the plurality of generally L-shaped members may be oriented in a generally parallel configuration. For example, each of the generally L-shaped members may extend across the width of coastal recovery module 10*a* in a generally parallel manner relative to one another. In some embodiments, at least a portion of the plurality of generally L-shaped members may be oriented at an angle relative to one another. For example, in an embodiment, the plurality of generally L-shaped members may form a generally zig-zag pattern on the top surface of coastal recovery module 10*a*. In another example embodiment, two or more of the generally L-shaped members may converge towards one another, e.g., at one side of coastal recovery module 10*a*. Various additional/alternative configurations are also contemplated.

Figure 3:
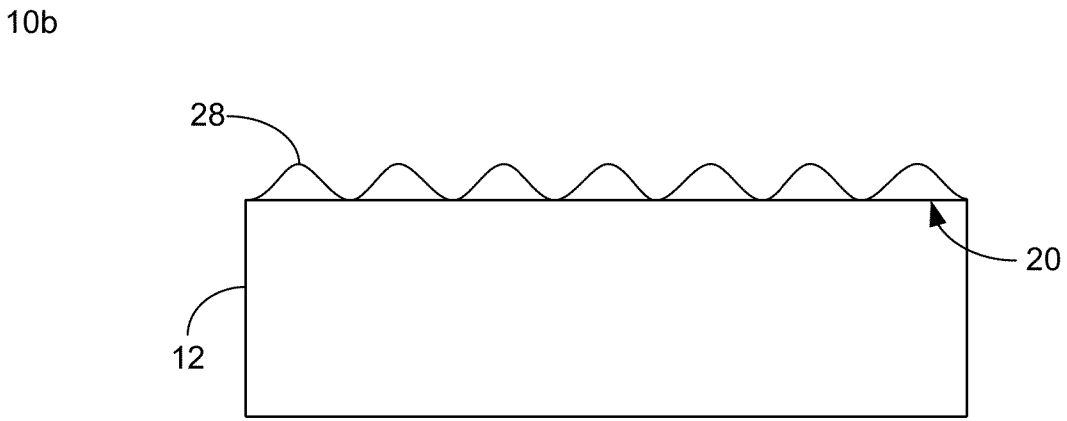
FIG. 3 diagrammatically depicts an embodiment of a coastal recovery module including an undulating surface wave energy mitigation member.

Referring to FIG. 3, in an embodiment coastal recovery module 10*b* may include a wave energy mitigation structure that may include an undulating surface having a plurality of undulations (e.g., undulation 28). In some embodiments, the plurality of undulations may result in destructive wave interference in waves passing over and/or breaking on coastal recovery module 10*b*. As shown, the plurality of undulations may include alternating convex and concave geometries. The plurality of undulations may be formed, e.g., from a sheet metal surface, a plastic surface, a concrete surface, or other suitable materials. In some embodiments, the undulating surface may be affixed to the top surface of the body portion. In some embodiments, the plurality of undulations may be an integral aspect of the top surface of the body portion. While the plurality of undulations have been depicted as being generally of the same size (e.g., the same height and width), one or more of the plurality of undulations may include a height and/or width that is different than the height and/or width of at least another of the plurality of undulations. In some embodiments, the plurality of undulations may be oriented generally parallel to one another. For example, as shown in the illustrated embodiment, the plurality of undulations may generally extend across the width of coastal recovery module 10*b* in a generally parallel orientation relative to one another. In an other example embodiment, at least a portion of the plurality of undulations may be oriented at an angle relative to one another. For example, in a similar manner as described with respect to the generally L-shaped members of coastal recovery module 10*a*, the plurality of undulations may form a generally zig-zag pattern on the top surface of coastal recovery module 10*b* and/or a portion of the undulations may converge toward one another at one side of coastal recovery module 10*b*, and/or be otherwise oriented in an angled relationship.

Figure 4:
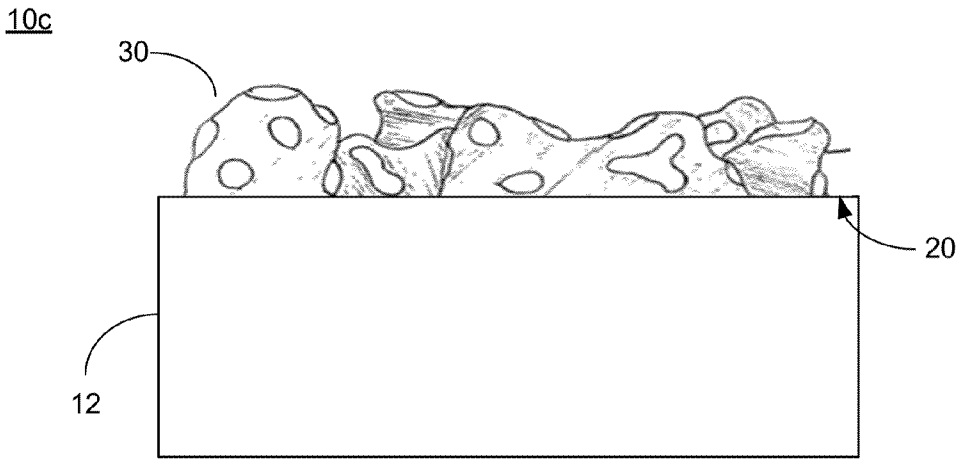
FIG. 4 diagrammatically depicts an embodiment of a coastal recovery module including a bio-habitat feature.
Figure 5:
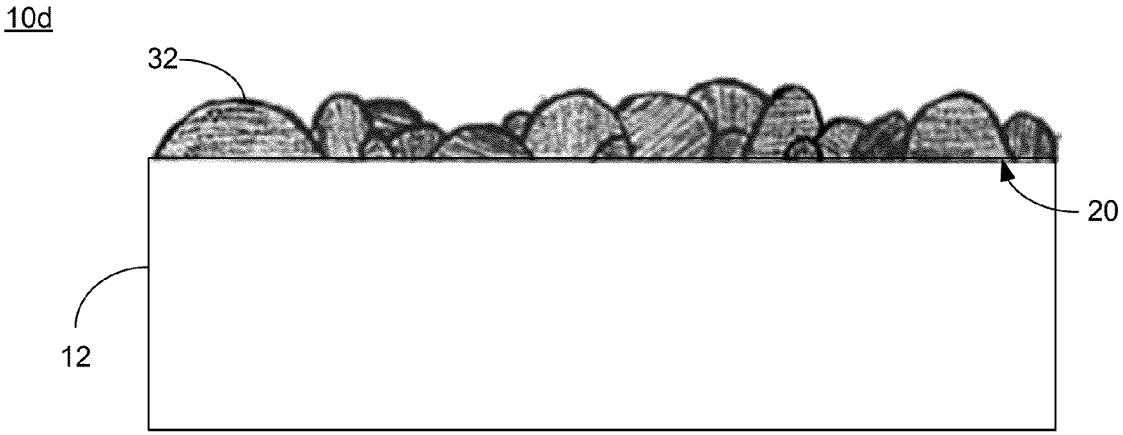
FIG. 5 diagrammatically depicts an embodiment of a coastal recovery module including a bio-habitat feature.

Referring also to FIGS. 4 and 5, the wave energy mitigation structure may include bio-habitat features. In addition/as an alternative to mitigating wave energy, the bio-habitat features associated with a coastal recovery module may enhance the near-shore system from an ecological perspective. For example, the bio-habitat features may mitigate habitat impacted by the installation of the coastal recovery module by providing a bio-habitat within a near-shore littoral cell. Consistent with various example embodiments, the bio-habitat features may include natural features, artificial features, and/or combinations of nature and artificial features. Additionally, in the case of natural features, the at least a portion of the bio-habitat features may include materials gathered from the environment and/or cultivated materials. Further, bio-habitat features may be collected from an environment in which the coastal recovery module may be utilized, an analogous environment, or the like.

According to various embodiments, various different bio-habitat features may be includes. For example, as shown in FIG. 4, according to an example embodiment, coastal recovery module 10*c* may include one or more reef features (e.g., reef 30) affixed to top surface 16 of body portion 12. Reef feature 30 may include, for example, coral fragments (e.g., living fragments, dead fragments, artificial fragments, etc.), oyster reefs, oyster shells, and the like. Further, as shown in FIG. 5, according to an example embodiment, coastal recovery module 10*d* may include one or more rock features (e.g. rock feature 32). The one or more rock features may include rocks and/or boulders of various sizes affixed to top surface 16 of body portion 12. Various additional/alternative bio-habitat features may also be includes, such as, but not limited to, natural and/or artificial sea grasses, concrete culverts, bio-mats, and/or any other suitable features and/or materials. As is generally known, a bio-mat may generally include textile mats made from natural and/or synthetic materials. Bio-mats may generally be used assist stabilizing a substrate, such that biotic colonization may be facilitated and/or accelerated. Further, it will be appreciated that various combinations of bio-habitat materials and/or features may be utilized in combination with one another, e.g., in the context of a single coastal recovery module and/or across multiple coastal recovery modules utilized in a common installation.

Figure 6:
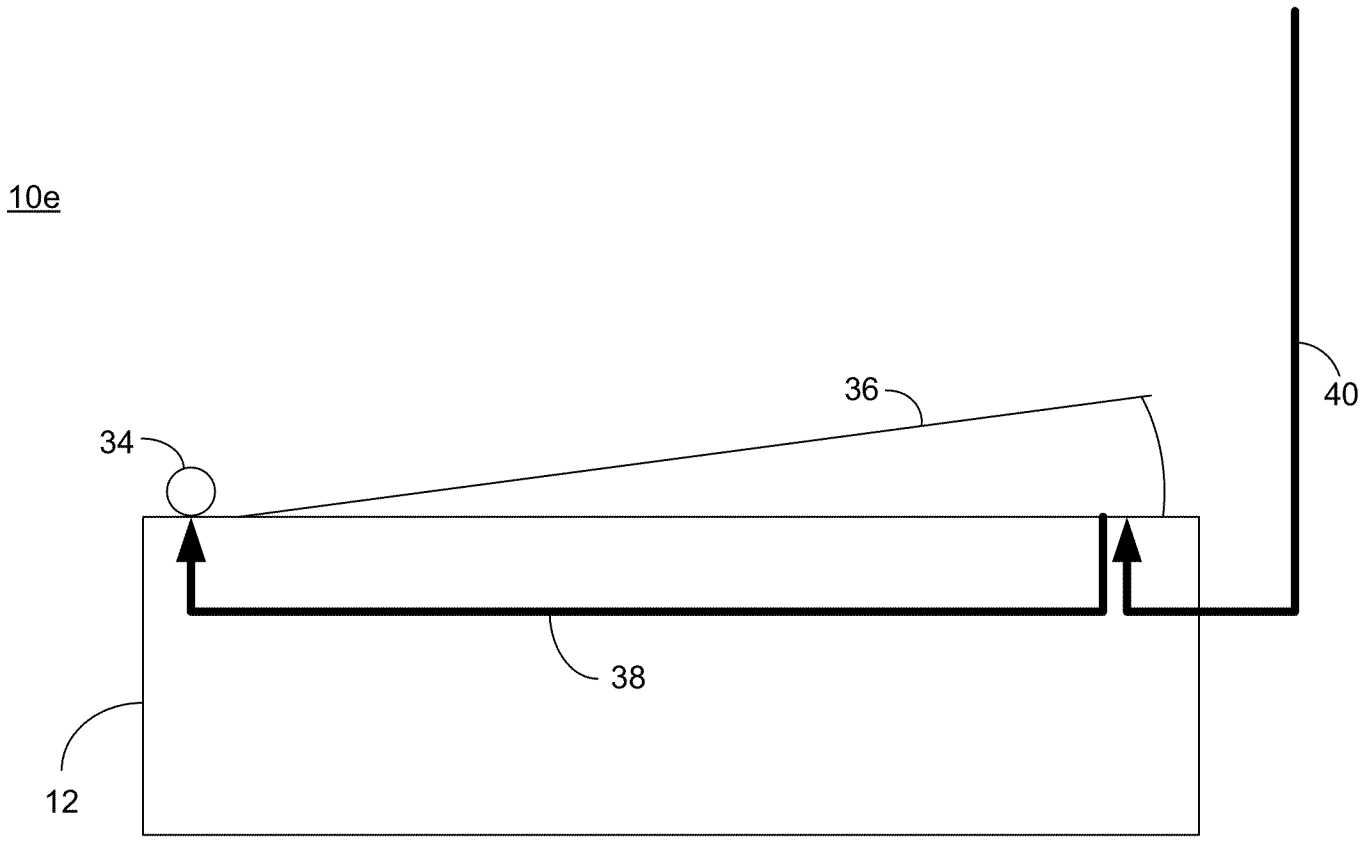
FIG. 6 diagrammatically depicts an embodiment of a coastal recovery module including an aeration wave energy mitigation feature.

With reference also to FIG. 6, in an embodiment coastal recovery module 10*e* may include a wave energy mitigation feature including an aeration system. According to an embodiment, the aeration system may be configured to dispense air bubbles, which may disrupt waves flowing across and/or breaking on coastal recovery module 10*e*. According to an embodiment, the aeration system may include one or more aeration manifolds (e.g., manifold 34) that may be configured to dispense a plurality of air bubbles along the length of manifold 34. For example, in some embodiments, manifold 34 may include a plurality of orifices and/or nozzles along the length thereof. The plurality of orifices and/or nozzles may dispense air bubbles from manifold 34. While only a single aeration manifold is depicted, it will be appreciated that a plurality of manifolds may be equally utilized.

In one embodiment, the aeration system may include an active aeration system. According to such an embodiment, aeration manifold 34 may be coupled with a supply of air (e.g., a tank of compressed air, an air compress located on the surface of the water and/or including an air compressor inlet on the surface of the water, etc.). According to another embodiment, and with particular reference to FIG. 6, the aeration system may include a passive aeration system (e.g., which may not require an external supply of compressed air). For example, coastal recovery module 10*e* may include a bellows structure 36. Bellows structure 36 may be configured to dispense air bubbles via aeration manifold in response to wave energy applied to bellows structure 36. For example, bellows structure 35 may include a flexible and/or elastically deformable air bladder that may be compressed in response to applied waver energy (e.g., resulting from a wave traveling over, and/or breaking on, coastal recovery module 10*e*. In an embodiment, bellows structure 36 may be coupled with aeration manifold 34 by air tube 38, e.g., for delivering air from bellows structure 36 to aeration manifold 34 when bellows structure is compressed by applied wave energy. In some embodiments, a snorkel line (e.g., snorkel line 40) may be coupled with bellows structure 36. Snorkel line 40 may allow bellows structure 36 to draw air from above the surface of the water (e.g., in an embodiment in which coastal recovery module 10*e* is partially and/or completely submerged). In an embodiment, snorkel line 40 may be supported by a buoy, or other floatation device, to maintain the inlet thereof above the water line (e.g., to enable bellows structure 36 to draw air from the surface). In some embodiments, one or more one way valves may be associated with one or more of bellows structure 36, aeration manifold 34, air tube 38 and snorkel line 40 to allow bellows structure 36 to draw air via snorkel line 40 and dispense air bubbles from aeration manifold 34 via air tube 38.

As generally discussed above, coastal recovery module 10 may include one or more selectively sealable fluid conduits (e.g., ports 16, 18) providing a fluid communication between interior compartment 14 and an exterior of body portion 12. The fluid conduit (e.g., ports 16, 18) may be configured for selectively flooding and dewatering the interior compartment. Further, in some embodiments, the port may include an opening adjacent a top of the body portion. A conduit may provide fluid communication between the opening and a portion of the interior compartment adjacent a bottom region of the interior compartment.

Figure 7A:
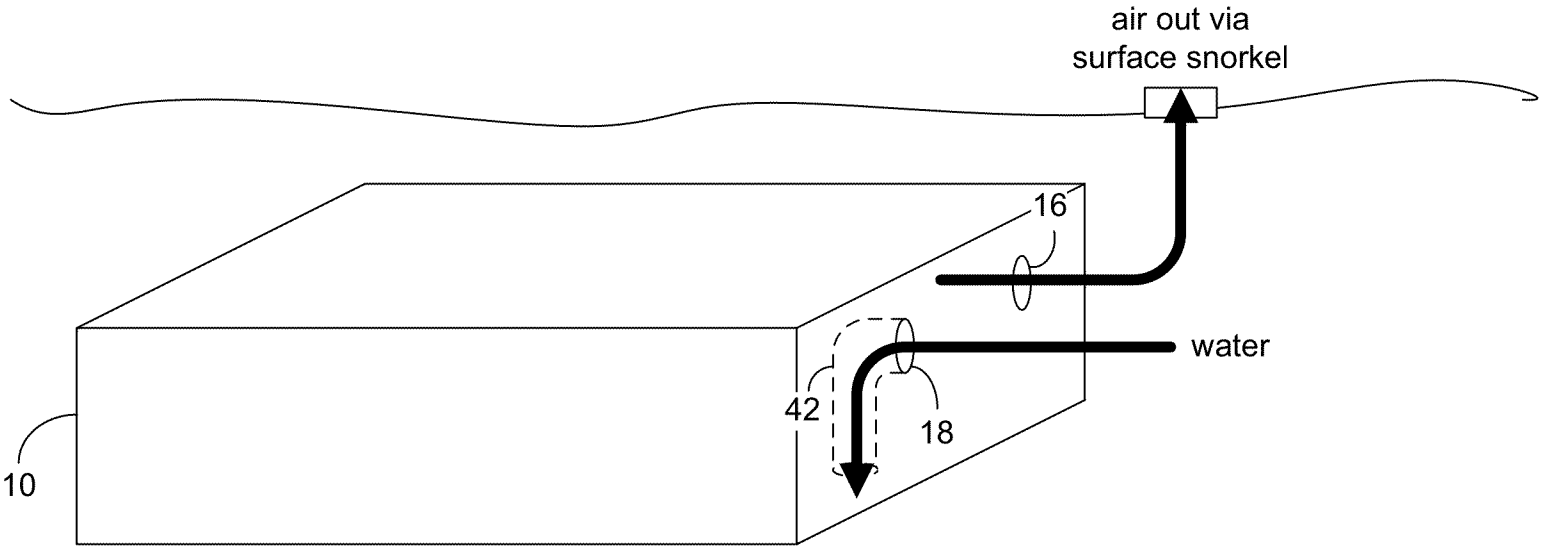
FIGS. 7*a* through 7*c* diagrammatically depict embodiments of a fluid conduit arrangement of a coastal recovery module.
Figure 7B:
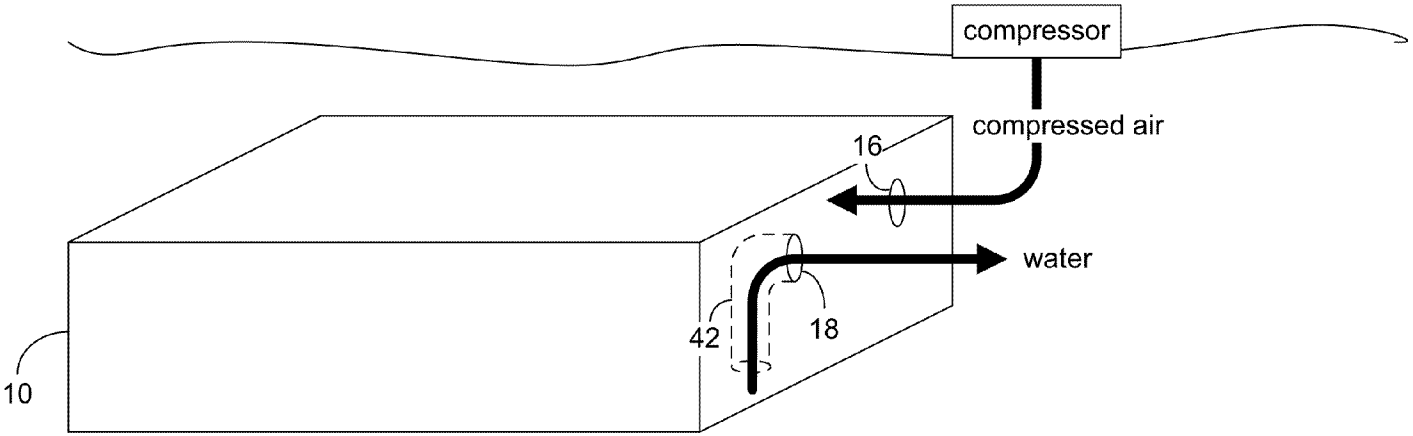
Figure 7C:
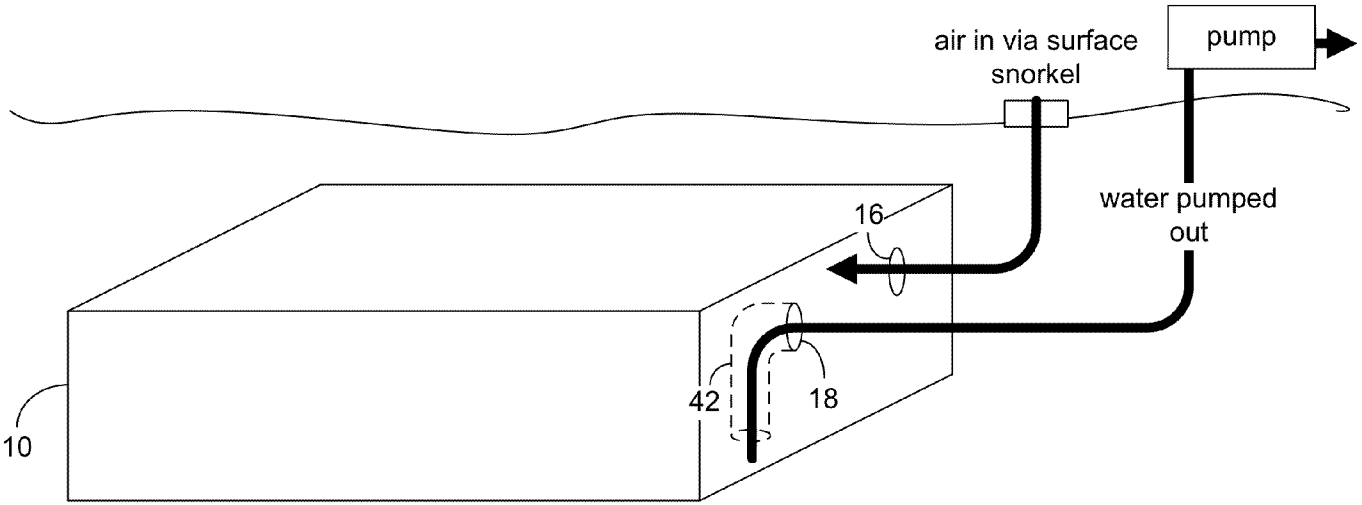

For example, and referring also to FIGS. 7*a* through 7*c*, an embodiment of coastal recovery module 10 is depicted. Consistent with the illustrated embodiment, coastal recovery module 10 may include one or more ports (e.g., ports 16, 18) that may provide fluid communication with the interior compartment of coastal recovery module 10. It will be appreciated that while only two ports (namely ports 16, 18) are shown, the number and arrangement of the ports may vary depending upon design criteria and user need. One or more of ports 16, 18 may include associated seacocks, connectors (e.g., including self closing connectors, which may, for example, achieve a closed condition when not coupled to a mating connector, etc.), and the like. Seacocks, connectors, valves, and the like may allow, for example, one or more of ports 16, 18 to be opened or closed (e.g., to allow fluid communication with the interior compartment of coastal recovery module 10, and/or to prevent fluid communication with the interior compartment of coastal recovery module 10), may allow hoses or equipment to be coupled for fluid communication with the interior compartment of coastal recovery module 10, and the like.

With particular reference to FIG. 7*a*, and continuing with the above discussed aspect in which the coastal recovery module may be at least partially filled with water (e.g., "flooded"), one possible arrangement for flooding coastal recovery module 10 (e.g., for the purpose of ballasting coastal recovery module 10) is shown. In the illustrated embodiment, port 16 may allow air to escape from coastal recovery module 10, for example via a hose (not shown) coupled to port 16. The other end of the hose (e.g., opposite the end of the hose that is coupled to port 16) may, for example, be supported above the surface of the water, by a float or other suitable arrangement. As such, the hose coupled to port 16 may effectuate a surface snorkel for exhausting air from within coastal recovery module 10. The other port (e.g., port 18) may be opened to allow water to flow into the interior compartment of coastal recovery module 10, thereby causing air to be exhausted from coastal recovery module 10 via port 16 and the hose connected thereto. Further, as shown, port 18 may include a downpipe (e.g., downpipe conduit 42) extending to a region proximate a bottom interior of coastal recovery module 10. Consistent with the illustrated arrangement, water may only enter coastal recovery module 10 via port 18, and may be direct to a region proximate a bottom of the interior compartment of coastal recovery module 10. Air, which may be displaced by the entering water, may be exhausted above, or near, the surface of the water. In such an arrangement, coastal recovery module 10 may be filled from the bottom up. Accordingly, coastal recovery module 10 may maintain its general orientation in the water (e.g., may have a decreased tendency to roll and/or flip over).

Referring to FIGS. 7*b* and 7*c*, two possible arrangements and methods are shown for removing the water from coastal recovery module 10 (e.g., "blowing down"/pumping out coastal recovery module 10). As shown in FIG. 7*b*, compressed air (e.g., which may be provided by a surface compressor, tanks of compressed air, or the like) may be introduced into the interior compartment of coastal recovery module 10 via port 16. The introduction of compressed air into coastal recovery module 10 may displace the water within the interior compartment of coastal recovery module 10, e.g., by forcing the water to exit coastal recovery module 10 via the downpipe (e.g., downpipe conduit 42) and port 18. As the downpipe (e.g., downpipe conduit 42) may extend to a region proximate a bottom of coastal recovery module 10, water may be displaced from coastal recovery module 10 down to the level of the interior open end of downpipe conduit 42.

In a related embodiment, depicted in FIG. 7*c*, rather than (or in addition to) displacing the water within the interior compartment of coastal recovery module 10 using compressed air, the water within coastal recovery module 10 may be pumped from within coastal recovery module 10. For example, a hose (not shown) may couple port 18 to an external water pump (e.g., which may be provided by a surface vessel). Water may be pumped out of coastal recovery module 10 (e.g., via port 18 and downpipe conduit 42). The water pumped out of coastal recovery module 10 may be replaced by air that may enter coastal recovery module 10 via a hose (not shown) coupled to port 16. The hose coupled to port 16 may extend above the surface (and/or may be coupled to a supply of air, e.g., one or more compressed air tanks) in the manner of a surface snorkel. As described with respect to FIG. 7*b*, as downpipe conduit 42 may extend to a region proximate a bottom of the interior compartment of coastal recovery module 10, water may be removed from coastal recovery module 10 down to the level of the interior open end of downpipe conduit 42.

Figure 9:
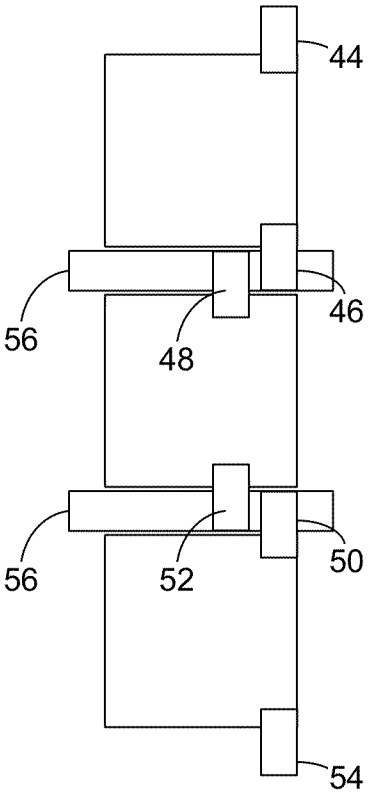
FIGS. 8 through 9 diagrammatically depict an embodiment of a spudding arrangement of a coastal recovery module.
Figure 8:
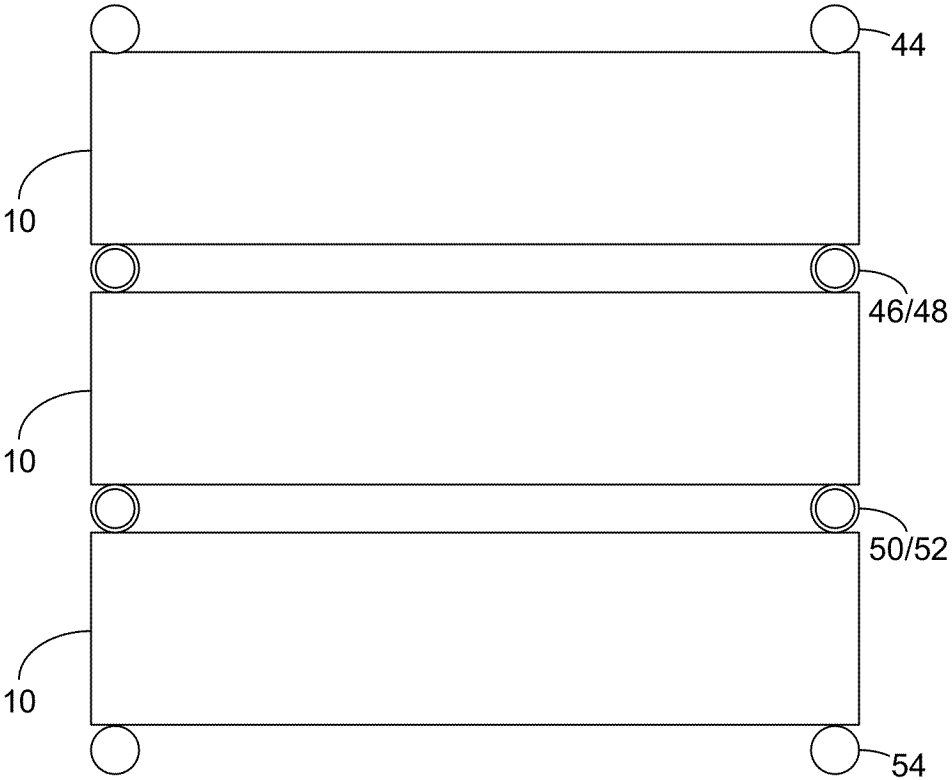

According to an example embodiment, coastal recovery module 10 may include one or more spud receptacles coupled with body portion 12. In general, a spud may include a generally vertical post (such as a steel rod, shaft, or tubular member; a steel reinforced, often pre-stressed, concrete cylindrical or square beam; wooden piling; or any other suitable material, orientation, geometry, and/or configuration) that may be coupled to the recovery module (e.g., as by being received through a spud receptacle, or "spud well"). For example, and referring also to FIGS. 8 and 9, coastal recovery modules 10 may include one or more spud receptacles, or "spud wells" couple with the body portion of the coastal recovery module. For example, as shown, spud receptacles 44, 46, 48, 50, 52, 54 (e.g., which may include, for example, a receptacle or opening in the recovery module and/or attached to the recovery module) may each be configured to receive a spud (e.g., spuds 56). Spuds 56 may be at least partially driven into the beach and/or sea floor, e.g., to thereby retain the coastal recovery modules in a desired location. In addition to securing the recovery modules to the seafloor, spudding may also be utilized for tying multiple recovery modules into a larger functional structure (e.g., as generally described with respect to FIGS. 8-9). Tying multiple recovery modules together may be accomplished, for example, by aligning at least one spud well of each respective adjacent recovery module (e.g., aligned spud receptacles 46, 48 and/or aligned spud receptacles 50, 52) with one another (e.g., in an overlapping manner) such that two, or more, recovery modules may share at least one common spud that may be at least partially received through each respective spud well. As shown, in an embodiment, spud receptacles associated with different coastal recovery modules, and/or with different sides of a coastal recovery module, may be disposed at a different height relative to the body portion of the coastal recovery module, thereby allowing more than one coastal recovery module to be positioned relative to another coastal recovery module with respective spud receptacles of adjacent coastal recovery modules positioned in an aligned (e.g., overlapping) manner, to allow a single spud to be received through a spud receptacle of each adjacent coastal recovery module. According to an embodiment, the aspect of tying multiple recovery modules together may allow for the creation of a functional structure one or more orders of magnitude larger that any single recovery module.

Figure 10:
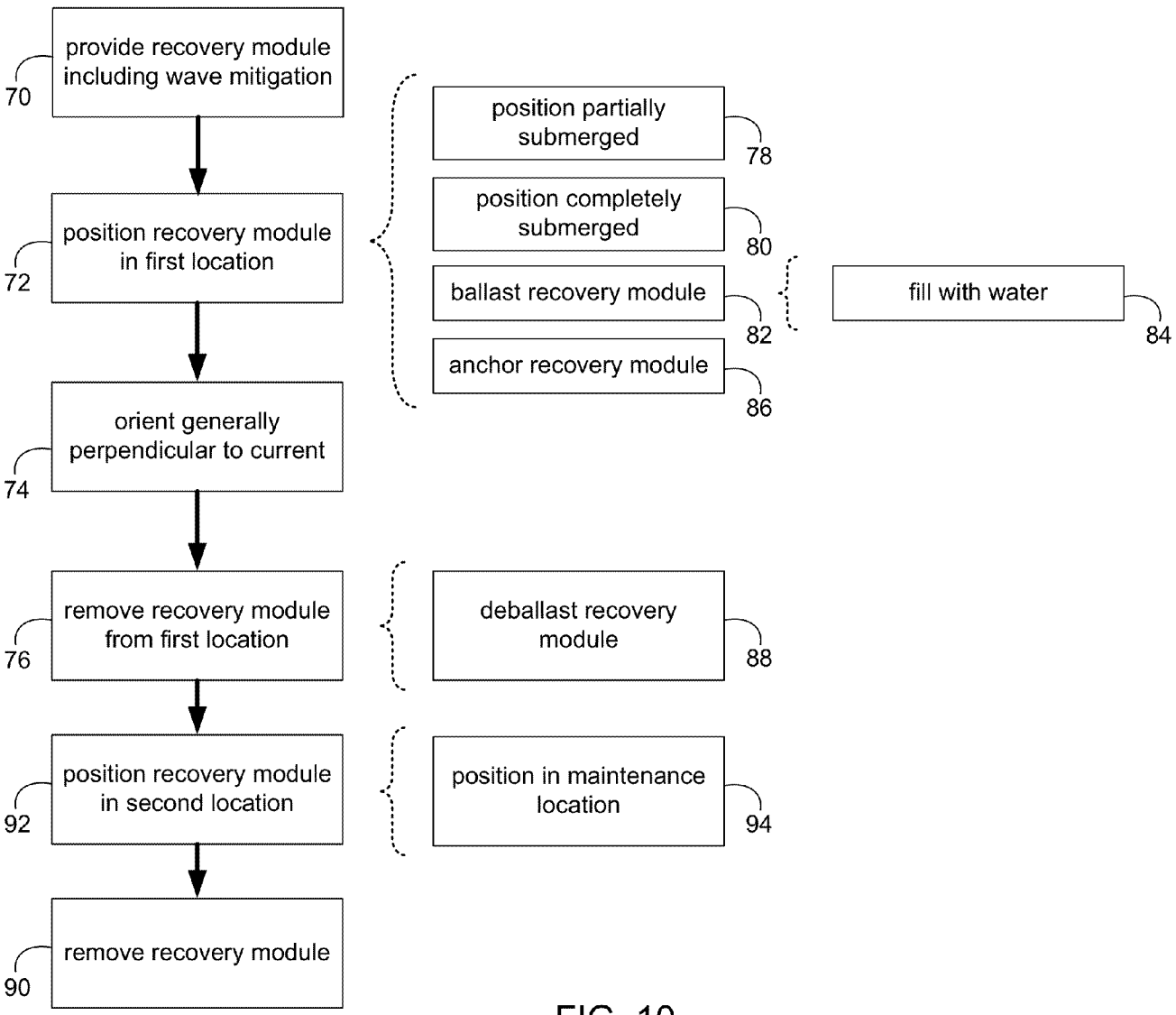
FIG. 10 is a flow chart of a method of coastal recovery.

Referring to FIG. 10, a method of coastal restoration and/or stabilization may generally include providing 70 a restoration module including a body portion defining an interior compartment, and a wave energy mitigation structure associated with at least a portion of a top surface of the body portion. Examples of recovery modules have been described hereinabove, e.g., with reference to FIGS. 1 through 9. The recovery module may be positioned 72 at a first location in a region relative to a beach to sea interface. A longitudinal axis of the recovery module may be oriented 74 generally perpendicular to a prevailing current. The recovery module may be removed 76 from the first location upon achieving a desired level of accretion relative to the recovery module. As used herein, coastal recovery and/or restoration may include coastal stabilization. Accordingly, the methods described herein may include methods for restoring a coastal region and/or for mitigating or reducing further erosion.

Figure 11:
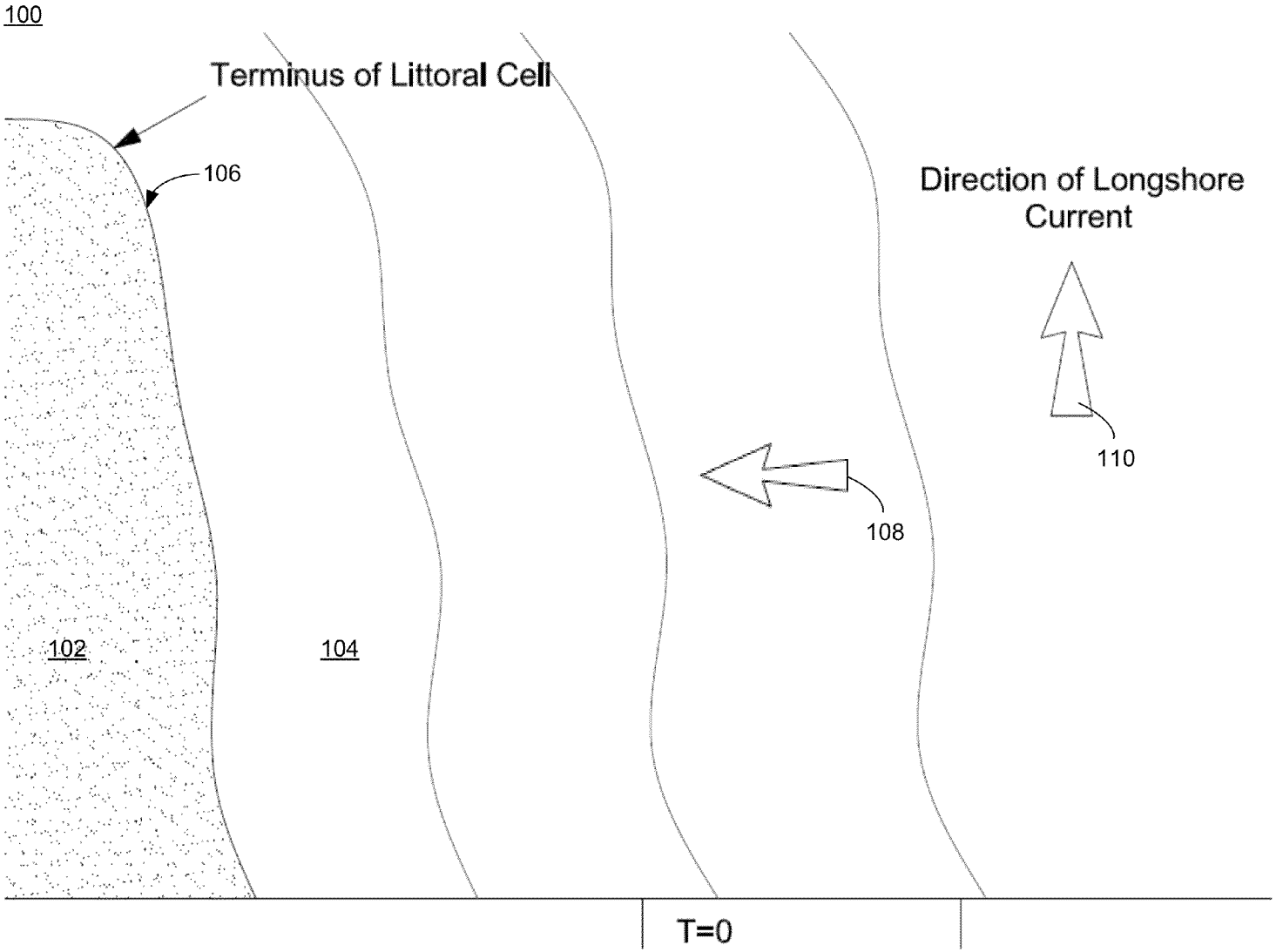
FIG. 11 diagrammatically depicts a portion of a coastline to be recovered.

Referring also to FIG. 11, in an illustrative example a littoral cell (e.g., littoral cell 100) is generally shown. Littoral cell 100 may generally include a region of coastline encompassing a beach region 102 and a sea region 104, and defining beach to sea interface 106, generally (e.g., the surf zone). As is known, beach to sea interface 106 may be a dynamic region (e.g., rather than a static or defined line), and may shift as a result of tidal action (e.g., the beach to sea interface may be further landward during high tide and further seaward during low tide), wave action, and a variety of other dynamic environmental circumstances and effects. Littoral cell 100 may be subject to a variety of currents. For example, an onshore current (e.g., onshore current 108) may include wave action resulting from waves approaching littoral cell 100. As is generally known, waves approaching littoral cell 100 may break in sea region 104 and/or in the region of beach to sea interface 106. The breaking of waves may additionally result in an uprush of water at beach to sea interface 106 and/or onto beach region 102, known as swash. The energy imparted by the breaking waves and/or swash may suspend sediment, such as sand, silt, and other particulate material, in the water. The suspended particulate material may generally be forced up the beach (e.g., onto beach region 102) generally in the direction of onshore current 108. The water may recede from beach region 102 (e.g., as backwash) in a direction that may be generally perpendicular to beach to sea interface 106 (e.g., the backwash may flow along the gradient of the beach) to seaward. Particulate material suspended in the water (e.g., as a result of the wave action) may carried away from beach region 102 and/or beach to sea interface 106, either down the coastline along the direction of the longshore current (e.g., longshore current 110, which may result in the difference in direction of the swash and the backwash) and/or seaward away from the beach region.

While onshore current 108 is shown as being substantially perpendicular to beach to sea interface 106, it will be appreciated that this is for illustrative purposes only. The direction of onshore current 108, e.g., which may include, at least in part, a direction of approach of waves toward beach to sea interface 106 in a dominant wave environment, may be at an angle other than perpendicular relative to beach to sea interface 106. The direction of the waves (and therein, at least in part, the direction of onshore current 108) may be based upon, at least in part, a wind direction (either local wind conditions or distant wind conditions, giving rise to resultant swell). Accordingly, while the direction of onshore current 108 may periodically change (e.g., seasonally, etc.), for at least discrete time periods onshore current 108 may have a generally prevailing direction.

Figure 12:
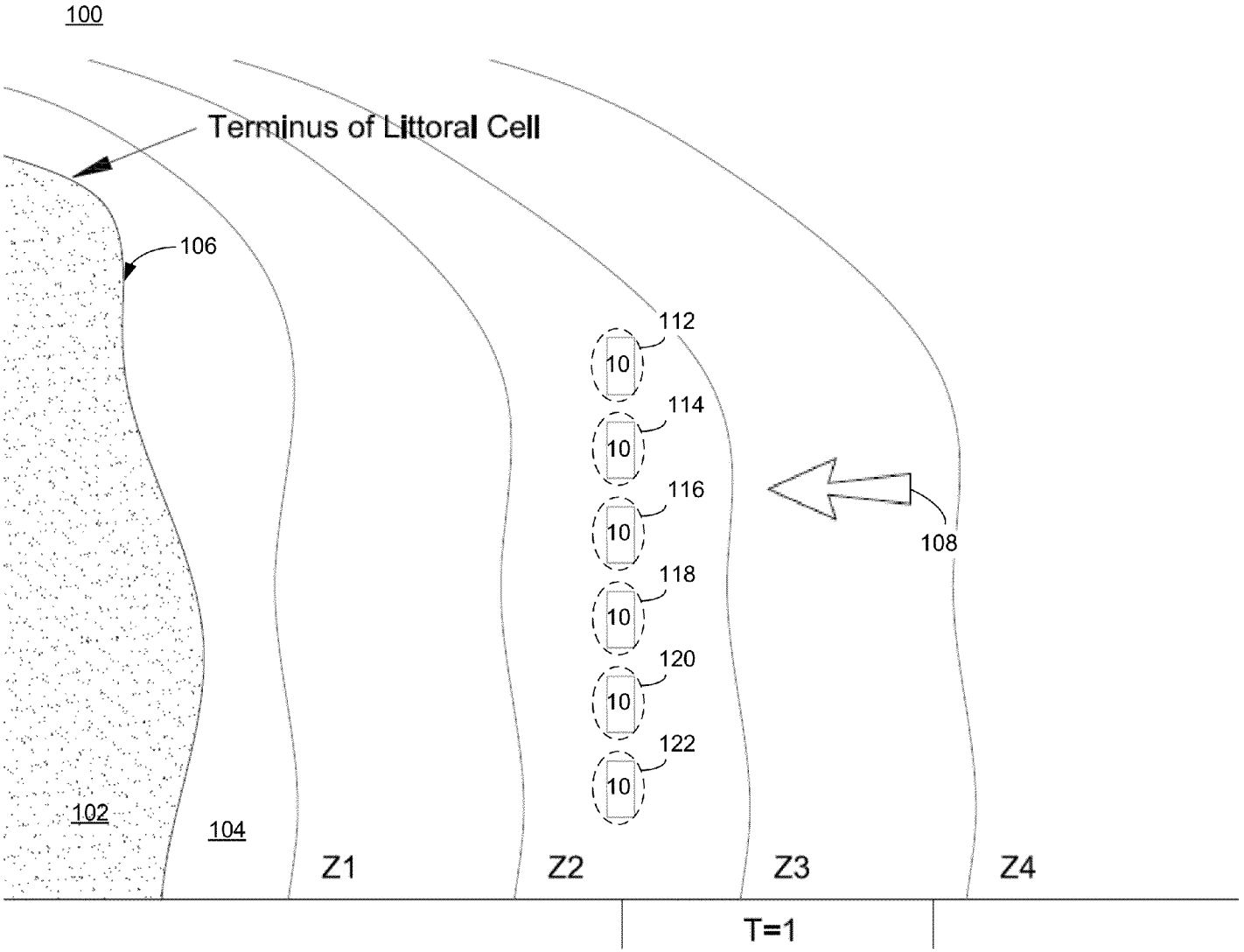
FIG. 12 diagrammatically depicts the portion of coastline of FIG. 11 including a plurality of recovery modules positioned relative thereto.

As mentioned above, coastal restoration may include positioning 72 a recovery module at a first location in a region relative to beach to sea interface 106. In one embodiment, positioning 72 a recovery module at a first location relative to beach to sea interface 106 may include positioning 72 the recovery module at a first location offshore of beach to sea interface 106. In such an embodiment, the recovery module may include a shore detached structure, e.g., in that the recovery module may be separated from beach region 102. Referring also to FIG. 12, in addition/as an alternative to a single recovery module (e.g., recovery module 10), the method of coastal restoration may equally utilize a plurality of recovery modules. In an implementation utilizing a plurality of recovery modules, the plurality of recovery modules may each be positioned 72 in a respective first location (e.g., respective location 112, 114, 116, 118, 120, 122) in a region offshore of beach to sea interface 106, as shown in FIG. 12.

It should be noted that while the figures herein may generally depict an implementation utilizing a plurality of recovery modules, the principles of the present disclosure are equally susceptible to the use of a single recovery module (e.g., recovery module 10). Further, while the figures herein generally depict an implementation utilizing six recovery modules, this is intended for the purpose of illustration only, as a greater or fewer number of recovery modules may be equally utilized. For example, depending upon the size of the littoral cell to be restored, twenty-four or more recovery modules may be utilized. As used herein, any characteristics, attributes, and operations described with respect to recovery module 10 may be equally attributable to any of the plurality of recovery modules. Further, the plurality of recovery modules may be generally analogous to one another (e.g., may include similar wave energy mitigation structures), and/or may differ from one another (e.g., one or more of the plurality of recovery modules may include a different wave energy mitigation structure than one or more other recovery modules of the plurality of recovery modules).

As described herein below, recovery module 10 may be positioned 72 in first location 112 (and/or plurality of first locations 112, 114, 116, 118, 120, 122) that may generally be in an offshore region of littoral cell 100. However, such an embodiment is intended for the purpose of explanation only (e.g., in the context of a specific embodiment of coastal recovery for a larger region of littoral cell 100, and/or the entirety of littoral cell 100, to be described in greater detail below), and should not be construed as a limitation. In various additional/alternative embodiments one or more recovery modules may be positioned 72 at any desired location(s) within littoral cell 100, e.g., to effectuate localized coastal recovery, and or to effectuate coastal recovery of a larger region of littoral cell 100 in an alternatively sequenced manner. All such implementations are considered to be within the contemplation of this disclosure.

According to one aspect, the one or more recovery modules may be positioned 72 in an offshore location relative to beach to sea interface 106 to disrupt and/or dissipate at least a portion of the energy of onshore current 108 (e.g., which may include disrupting and/or dissipating at least a portion of the energy of incoming waves). For example, the one or more recovery modules may be positioned to decrease the energy of the coastal system (i.e., disrupt and/or dissipate at least a portion of the energy of onshore current 108) by acting as a breakwater. In this manner, the one or more recovery modules may cause waves approaching beach to sea interface 106 may to break further offshore (e.g., as compared with location at which incoming waves may break in the absence of the one or more recovery modules). In an embodiment in which incoming waves may break further offshore, the energy of the onshore current (e.g., which may include residual waves and swash reaching beach to sea interface 106) at beach to sea interface 106 be decreased, resulting in less energy in the near-shore region of littoral cell 100. The lower energy of onshore current 108 at beach to sea interface 106 may decrease that ability of the water to suspend particulate material (e.g., sand and/or other sediment). As less particulate material may be suspended in the water, less particulate material may be subject to longshore drift (e.g., carried in a direction of the longshore current), and/or carried back out to sea.

Further, in some embodiments, the disruption and/or dissipation of at least a portion of the energy of onshore current 108 may be facilitated and/or enhanced by the wave energy mitigation features of recovery module 10. For example, the various wave energy mitigation features of recovery module 10 may disrupt the organized flow of onshore current 108, may impart destructive wave interference, and/or otherwise attenuate the energy of onshore current 108.

Consistent with the foregoing aspect, in which the one or more recovery modules (e.g., one or more of recovery modules 10), a longitudinal axis of the recovery module may be oriented 74 generally perpendicular to prevailing onshore current 108. Consistent with the illustrated example, orienting 74 a longitudinal axis of recovery module 10 generally perpendicular to onshore current 108 may include orienting a longitudinal axis of recovery module 10 generally parallel to beach to sea interface 106. The degree of disruption and/or dissipation of the energy of incoming waves may be based upon, at least in part, a dimension of the recovery module that is oriented 74 generally perpendicular to onshore current 108 (e.g., which in the illustrated embodiment may be generally parallel to beach to sea interface 106). As such, orienting 74 a longitudinal axis of the recovery module (e.g., a longitudinal axis of recovery module 10) generally parallel to beach to sea interface 106 may maximize the disruption and/or dissipation of the energy of incoming waves in a near-shore region relative to the one or more recovery modules (i.e., a region between the one or more recovery modules and the beach to sea interface). However, it should be appreciated that orienting 74 a longitudinal axis of the recovery module generally perpendicular to onshore current 108 may include other orientations of the one or more recovery modules (including an orientation in which the longitudinal axis of the one or more recovery modules is generally perpendicular to beach to sea interface 106). Such other orientations may also be utilized with varying degrees of efficacy (e.g., which may be based upon, at least in part, the degree of resultant disruption and/or dissipation of onshore current 108, which may include incoming waves, as well as relative aspect ratios of the one or more recovery modules, etc.).

Further, as shown in FIG. 12, beach to sea interface 106 may not be a linear feature. As such, orienting 74 the longitudinal axis of the one or more recovery modules generally perpendicular to onshore current 108 (e.g., generally parallel to beach to sea interface 106 in the illustrated embodiment) need not necessitate orienting 74 each of the individual recovery modules generally parallel to a respective expanse of beach to sea interface 106 (however, such an arrangement is considered within the scope of this disclosure). Rather, the longitudinal axis of the one or more recovery modules 10 may collectively be each be oriented 74 generally perpendicular to onshore current 108 (e.g., and thereby generally parallel to an average linear orientation of beach to sea interface). Further, in an arrangement including a plurality of recovery modules, the linear axes of at least a portion of recovery modules may be collinear. Additionally/alternatively, the longitudinal axes of one or more of recovery modules 10 may be oriented generally parallel to beach to sea interface 106, but may be disposed in an offset arrangement (i.e., non-collinear) relative to at least another of the one or more recovery modules.

Further, it will be appreciated that the direction of onshore current 108 may vary over time, both in the short term and the long term. However, it may be appreciated that the onshore current may, at least over a period of weeks or months, have a prevailing direction, either in terms of greatest strength and/or in terms of average greatest time (e.g., swell which may result from relatively consistent winds at sea as compared with more variable wind seas dependant upon current local conditions). Accordingly, the longitudinal axis of the one or more recovery modules may be oriented 74 generally perpendicular to a direction of onshore current 108 representing a direction of the greatest strength and/or greatest average time onshore current. Additionally, as will be discussed below, the one or more recovery modules may be susceptible to repositioning/relocation. Accordingly, in the event of a change in the prevailing direction of onshore current 108 (e.g., due to normal seasonal cycles, a predicted storm, etc.), the one or more recovery modules may be repositioned to orient 74 a longitudinal axis of the one or more recovery modules generally perpendicular to the changed (or anticipated new) direction of onshore current 108.

Positioning 72 the one or more recovery modules (e.g., one or more of recovery modules 10) in the one or more first locations (e.g., one or more of first locations 112, 114, 116, 118, 120, 122) may include positioning 78 the one or more recovery modules to be at least partially submerged during at least a portion of a tidal cycle. For example, positioning 78 the recovery module 10 to be at least partially submerged during at least a portion of a tidal cycle may include positioning 78 recovery module 10 so that at least a portion of recovery module 10 is disposed below the average water level (e.g., the water level at a midpoint between the crest and trough of a wave) during at least a portion of a tidal cycle. In an at least partially submerged position, recovery module 10 may be (but is not required to be) completely submerged during at least a portion of a tidal cycle (e.g., during high tide) and/or in above average seas for littoral cell 100.

Further, positioning 72 the one or more recovery modules (e.g., recovery module 10) in the first location (e.g., location 112) may include positioning 80 recovery module 10 to be completely submerged during the tidal cycles. In such a configuration, recovery module 10 may be completely submerged during the entire tidal cycle (e.g., may be below the average water level at a midpoint between the crest and trough of a wave at an average low tide condition). In a completely submerged position, recovery module 10 may be (but is not required to be) at least partially emergent during at least a portion of a tidal cycle that is below average for littoral cell 100. As such, recovery module 10 may be positioned 80 such that the full height of recovery module may be below the average water level for an average low tide condition for littoral cell 100.

In an embodiment in which the one or more recovery modules may be positioned 72 to break incoming waves further off shore (as compared to a condition not including one or more recovery modules), the location of the one or more recovery modules with respect to beach to sea interface 106 (e.g., the distance of the one or more recovery modules from the beach to sea interface) may depend upon a number of factors. For example, the location of breaking waves may depend, at least in part, upon the seafloor profile adjacent beach to sea interface 106, with waves tending to break farther from beach to sea interface 106 in locations having a relatively shallow seafloor profile and waves tending to break closer to beach to sea interface 106 in locations having a relatively steep seafloor profile. Accordingly, in locations having a relatively shallow seafloor profile in the region of beach to sea interface 106, the one or more recovery modules may be positioned 72 relatively farther away from beach to sea interface 106. Correspondingly, in locations having a relatively steep seafloor profile in the region of beach to sea interface 106, the one or more recovery modules may be positioned 72 relatively closer to beach to sea interface 106.

Additionally, the location of the one or more recovery modules with respect to beach to sea interface 106 may be based upon a desired size of waves to be broken by the one or more recovery modules. For example, for a given seafloor profile and recovery module height, a recovery module located further from beach to sea interface 106 may break relatively larger waves, while allowing relatively smaller waves to pass unbroken. Correspondingly, a recovery module located closer to beach to sea interface 106 may break relatively smaller waves (e.g., with relatively larger waves possibly having already broken due to decreased water depth based upon wave size and seafloor profile). Accordingly, the one or more recovery modules may be positioned 72 to break waves of a general size (e.g., which may be capable of imparting a general energy capable of suspending particulate material at beach to sea interface 106), to thereby disrupt and/or dissipate at least a portion of the energy of onshore current 108 in the region of beach to sea interface 106.

Further, the location of the one or more recovery modules with respect to beach to sea interface 106 may be based upon, at least in part, a height of the one or more recovery modules. For example, a relatively taller recovery module (e.g., in terms of prominence from the seafloor) in a given location may result in less water depth above the recovery module than a relatively shorter recovery module in the same given location. The less water depth above the relatively taller recovery module may result in waves of a relatively smaller size being broken as compared to the size of waves that may be broken by the relatively shorter recovery module in the same given location.

In consideration of the foregoing discussion, the present disclosure is not intended to be limited by the distance from beach to sea interface 106 at which the one or more recovery modules are positioned 72. Such distances are considered to be based upon conditions in the region of beach to sea interface 106 and design choice.

Figure 13:
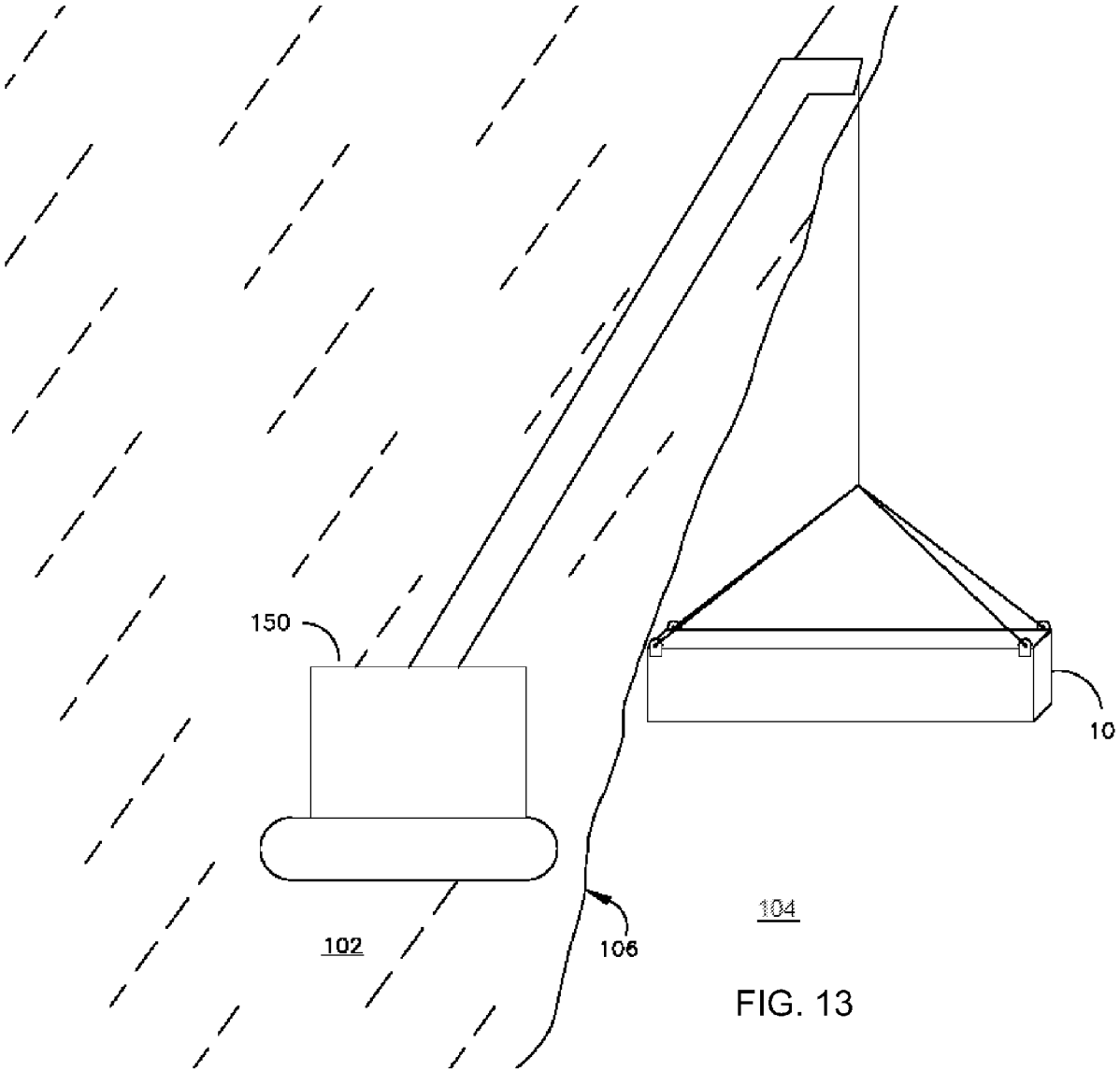
FIGS. 13 through 15 diagrammatically depict example methods for deploying recovery modules.
Figure 14:
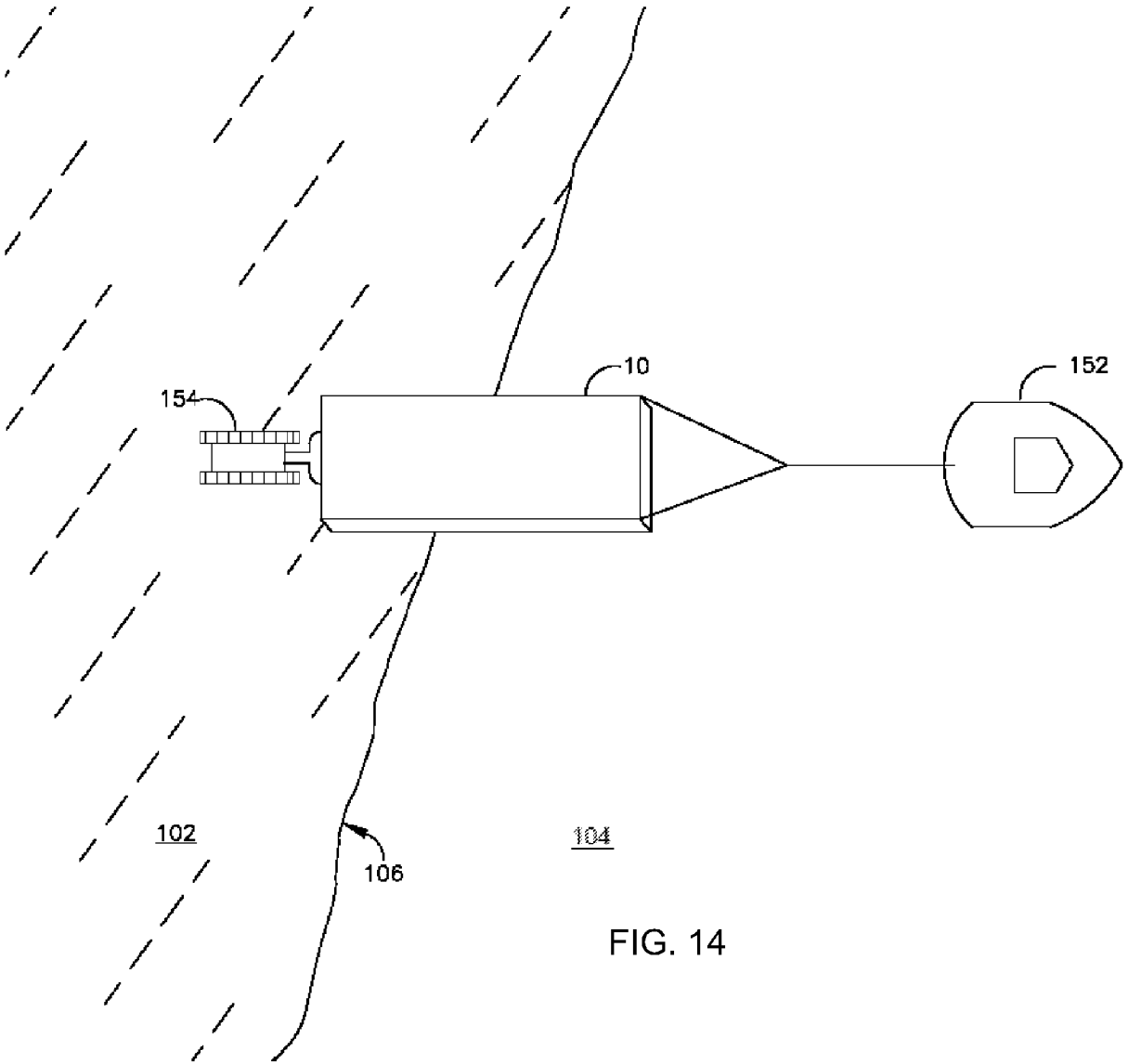
Figure 15:
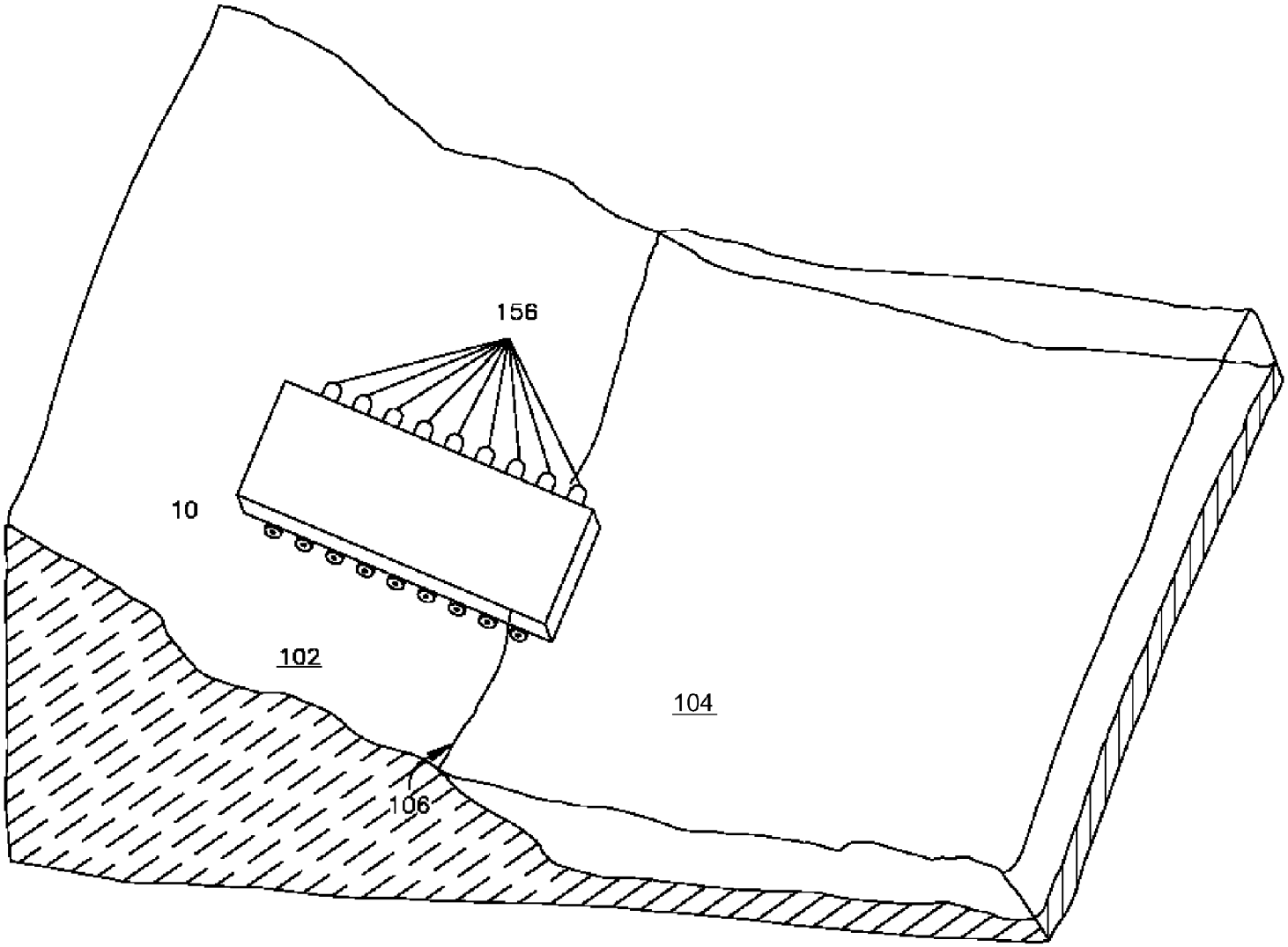

Referring also to FIGS. 13 through 15, various techniques may be used to position 72 the one or more recovery modules (e.g., recovery module 10). For example, as shown in FIG. 13, recovery module 10 may be deployed and positioned 72 from beach 102 utilizing crane 150, an excavator, forklift, loader, or similar heavy equipment. In such an embodiment, crane 150 may transport recovery module 10 across beach 102 and may position 72 recovery module 10 in a desired location relative to beach to sea interface 106.

Referring to FIG. 14, recovery module 10 may be deployed from land and may be positioned 72 from sea and/or land. Further in some embodiments, recovery module may be deployed from sea, and may be positioned 72 from sea and/or land. For example, recovery module 10 may be deployed from beach 102 and into sea 104. Once deployed into sea 104, recovery module 10 may be towed, e.g., by being towed by a suitable tow vessel (e.g., boat 152), through the sea to a position generally proximate first location 112. Recovery module 10 may be positioned 72 by boat 152 pushing recovery module 10 into first location 152. In some embodiments, beach-based heavy equipment (e.g., bulldozer 154, a crane, an excavator, a forklift, a loader, or other suitable beach-based equipment) may assist in deploying recovery module 10 from beach 102 into sea 104. Further, in some embodiments, beach-based heavy equipment may assist positioning 72 recovery module 10 in a desired location.

Referring to FIG. 15, in another example, recovery module 10 may be deployed across beach 102 using intense pneumatic tires 156, collectively, as rollers for traversing beach 102 and positioning 72 recovery module 10 in a desired first location, and/or deploying recovery module 10 into sea 104, from where recovery module 10 may be otherwise positioned 72 in a desired first location (e.g., via the assistance of a boat and/or land-based equipment). As is generally known, intense pneumatic tires (also known as "roller bags," "shipping air bags," and "salvage bags") may generally include inflatable, generally cylindrical structures. As indicated above, intense pneumatic tires 156 may be used as rollers for deploying recovery module 10 across beach 102. As recovery module 10 rolls across intense pneumatic tires 156, individual intense pneumatic tires may exit from the rear of recovery module 10, and may be moved in front of recovery module 10. Recovery module 10 may subsequently roll across an intense pneumatic tire moved in from of recovery module. During deployment of recovery module 10 using intense pneumatic tires 156, recovery module 10 may, for example, be manually pushed and/or pushed using suitable equipment, such as a tractor, bulldozer, loader, etc. Once recovery module 10 has been deployed into sea 104 and/or positioned 72 in a desired first location, any intense pneumatic tires 156 positioned under recovery module 10 may be deflated, and either removed or left in place for subsequent repositioning of recovery module 10. Various additional/alternative techniques may equally be utilized for deploying and positioning the one or more recovery modules in desired locations at the beach to sea interface.

Once deployed into the water, recovery module 10 may be floated (e.g., in embodiments in which the recovery module may be at least partially buoyant, as discussed above) to a desired location. For example, a barge or work boat may be utilized to tow or push recovery module 10 to a desired location. Upon reaching the desired location, recovery module 10 may be positioned 10 in a desired location on the seafloor. For example, recovery module 10 may be flooded (e.g., as described with respect to FIGS. 7*a*-7*c*) or otherwise ballasted to achieve a neutral, or at least partially negative, buoyancy. Recovery module 10 may be guided to a desired position and orientation on the seafloor using any suitable means, including but not limited to cranes and the like.

In further embodiments, e.g., in which recovery module 10 may not be at least partially buoyant, recovery module 10 may be positioned 72 on the seafloor using, for example, a barge mounted crane, or other suitable equipment. In such an embodiment, recovery module 10 may be, for example, craned from a transport barge and lowered to the water and positioned 72 using the crane in a desired location (e.g., location 112) on the seafloor. Various additional/alternative techniques for positioning the one or more recovery modules may suitably be employed. As such, the present disclosure is not intended to be limited by the foregoing illustrative examples.

Consistent with the foregoing description, in which the one or more recovery modules (e.g., recovery modules 10) may be at least partially submerged, the one or more recovery modules may stabilized on the seafloor to aid in maintaining the one or more recovery modules in a desired location (e.g., in respective locations 112, 114, 116, 118, 120, 122). According to one embodiment, positioning 72 the one or more recovery modules may include ballasting 82 the one or more recovery modules to thereby maintain the one or more recovery modules in the desired location. Consistent with the foregoing description, in some embodiments the one or more recovery modules may include at least partially hollow structures, defining an interior compartment. The interior compartment of the one or more recovery modules may be at least partially emptied to achieve neutral or positive buoyancy for the purpose of floating the one or more recovery modules to a desired location. Once the one or more recovery modules have been floated to a desired location, the one or more recovery modules may be positioned in respective first locations on the seafloor (e.g., respective first locations 112, 114, 116, 118, 120, 122) including ballasting 82 the one or more recovery modules. Ballasting 82 the one or more recovery modules may increase the weight of the one or more recovery modules to allow positioning 72 the one or more recovery modules on the seafloor (e.g., by sinking the one or more recovery modules, or achieving a generally neutral buoyancy that may allow facile positioning of the one or more recovery modules on the seafloor). Accordingly, once the one or more recovery modules have been ballasted 82, the one or more recovery modules may be less susceptible to undesired movement.

It is appreciated that the strata of the seafloor may vary in consistency and stability. Such variations in consistency and stability may, in some situations, result in settling or movement of the one or more recovery modules. Unintended settling of the one or more recovery modules may, in some circumstances, inhibit and/or undesirably increase the difficulty of further repositioning and/or removal of the one or more recovery modules. Additionally, unintended settling may impact the efficacy of the one or more recovery modules in disrupting or dissipating energy of onshore current 108 (e.g., by increasing the depth of the water above the one or more recovery modules). Similarly, unintended settling of the one or more recover modules may result in the one or more recovery modules moving from the desired location on the seafloor (e.g., locations 112, 114, 116, 118, 120, 122), and/or moving from a desired orientation relative to beach to sea interface 106 and/or onshore current 108. In order to at least partially control the degree of settling or movement of the one or more recovery modules, the degree of ballasting (e.g., and therein the resulting negative buoyancy, or effective weight applied to the seafloor) may be determined based upon, at least in part, the nature of the seafloor. Such control of the degree of ballasting may be carried out to reduce and/or control the degree of settling experienced by the one or more recovery modules. In various embodiments, the degree of ballasting 82 may be varied by the selection of ballasting materials, the amount of ballasting material, the inclusion of low density materials (e.g., foam materials, air bladders, or other low density materials), and the like. In addition, baffling may be used in conjunction with, or exclusive of the aforementioned ballasting materials, to minimize, mitigate, and/or other wise eliminate undesired settling of the one or more recovery modules.

As generally discussed with reference to the description of FIGS. 7*a*-7*c*, ballasting 82 of the one or more recovery modules may include at least partially filling 84 the one or more recovery modules with water. For example, as described above, the one or more recovery modules may be at least partially filled 84 with water by pumping water into the one or more recovery modules, opening one or more seacocks below the water level (e.g., an possible also providing one or more air vents to allow for the escape of air from the one or more recovery modules as water enters the recovery module), etc., thereby allowing the one or more recovery modules to at least partially flood. As noted above, in addition/as an alternative to at least partially filling 84 the one or more recovery modules with water, the one or more recovery modules may be ballasted 82 with other materials, such as sand, rocks, etc.

In addition/as an alternative to ballasting 82 the one or more recovery modules, positioning 72 the one or more recovery modules may include anchoring 86 the one or more recovery modules in the respective first locations (e.g., first locations 112, 114, 116, 118, 120, 122). Anchoring 86 the one or more recovery modules may also advantageously be employed when, for example, the seafloor strata lacks the necessary stability to carry the weight of a fully ballasted recovery module without undesired settling or shifting of the one or more recovery modules. In such an implementation, the one or more recovery modules may be ballasted to achieve a buoyancy that can acceptably be carried by the seafloor (e.g., neutral buoyancy, or an acceptable degree of negative buoyancy). The one or more recovery modules may then be anchored 86 to the seafloor, e.g., to aid in maintaining the one or more recovery modules in the desired first locations. Further, the one or more recovery modules may also be anchored 86 even in embodiments in which the one or more recovery modules may be optimally ballasted (e.g., to aid in maintaining the desired location of the one or more recovery modules). The one or more recovery modules may be anchored 86 using any suitable known anchor, such as a mushroom anchor, earth auger, etc.

In a similar manner, the recovering module may be anchored 86 by spudding. As generally described above, a spud may generally include a generally vertical post (such as a steel rod, shaft, or tubular member; a steel reinforced, often pre-stressed, concrete cylindrical or square beam; wooden piling; or any other suitable material, orientation, geometry, and/or configuration) that may be coupled to the recovery module (e.g., as by being received through a spud well, such as a receptacle or opening in the recovery module and/or attached to the recovery module) and may be at least partially driven into the beach and/or sea floor. In addition to securing the recovery modules to the seafloor, spudding may also be utilized for tying multiple recovery modules into a larger functional structure (e.g., as generally described with respect to FIGS. 8-9). Tying multiple recovery modules together may be accomplished, for example, by aligning at least one spud well of each respective adjacent recovery module with one another (e.g., in an overlapping manner) such that two, or more, recovery modules may share at least one common spud that may be at least partially received through each respective spud well. According to an embodiment, the aspect of tying multiple recovery modules together may allow for the creation of a functional structure one or more orders of magnitude larger that any single recovery module.

Figure 16:
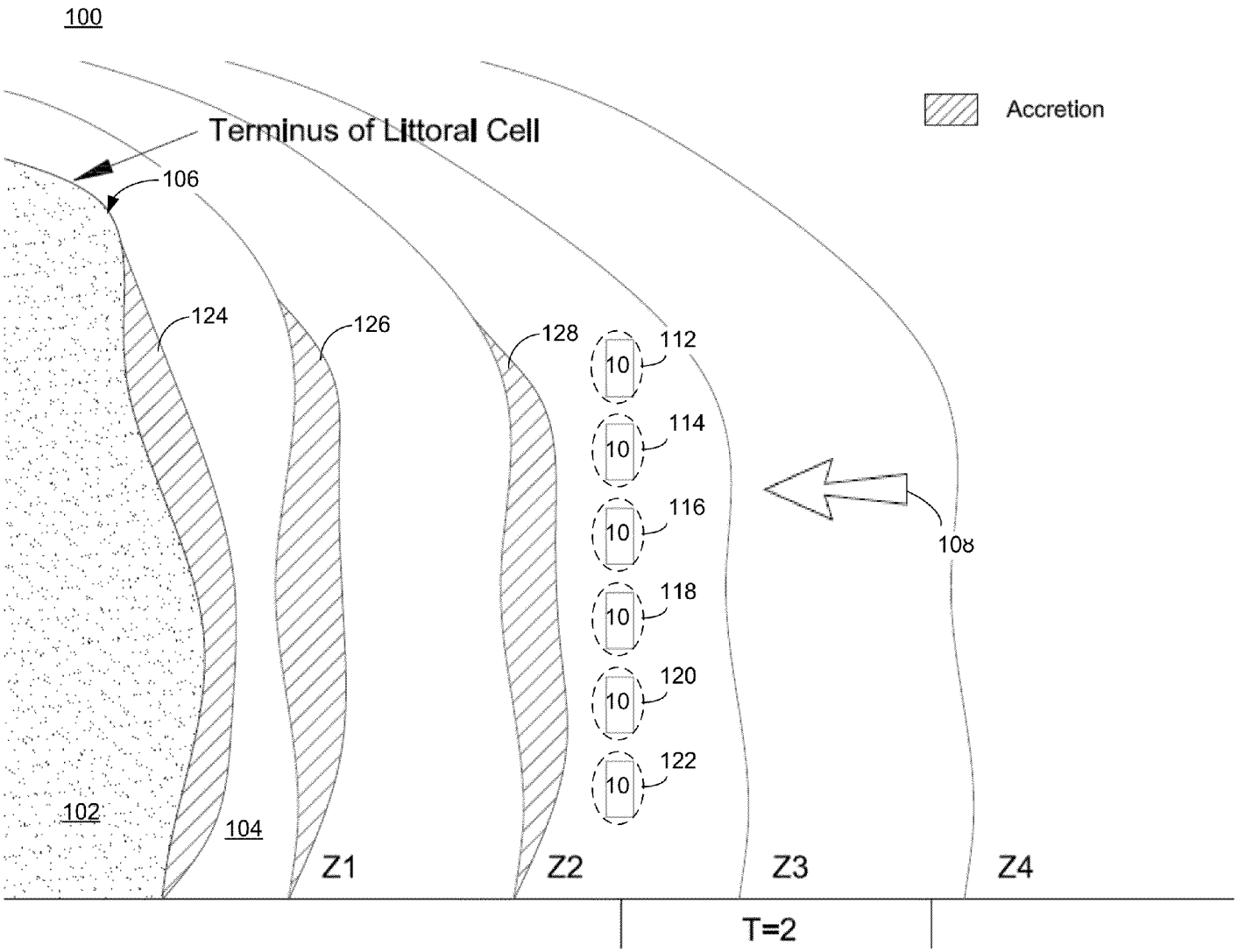
FIG. 16 diagrammatically depicts the formation of an accretion zone proximate to a plurality of recovery modules.
Figure 17:
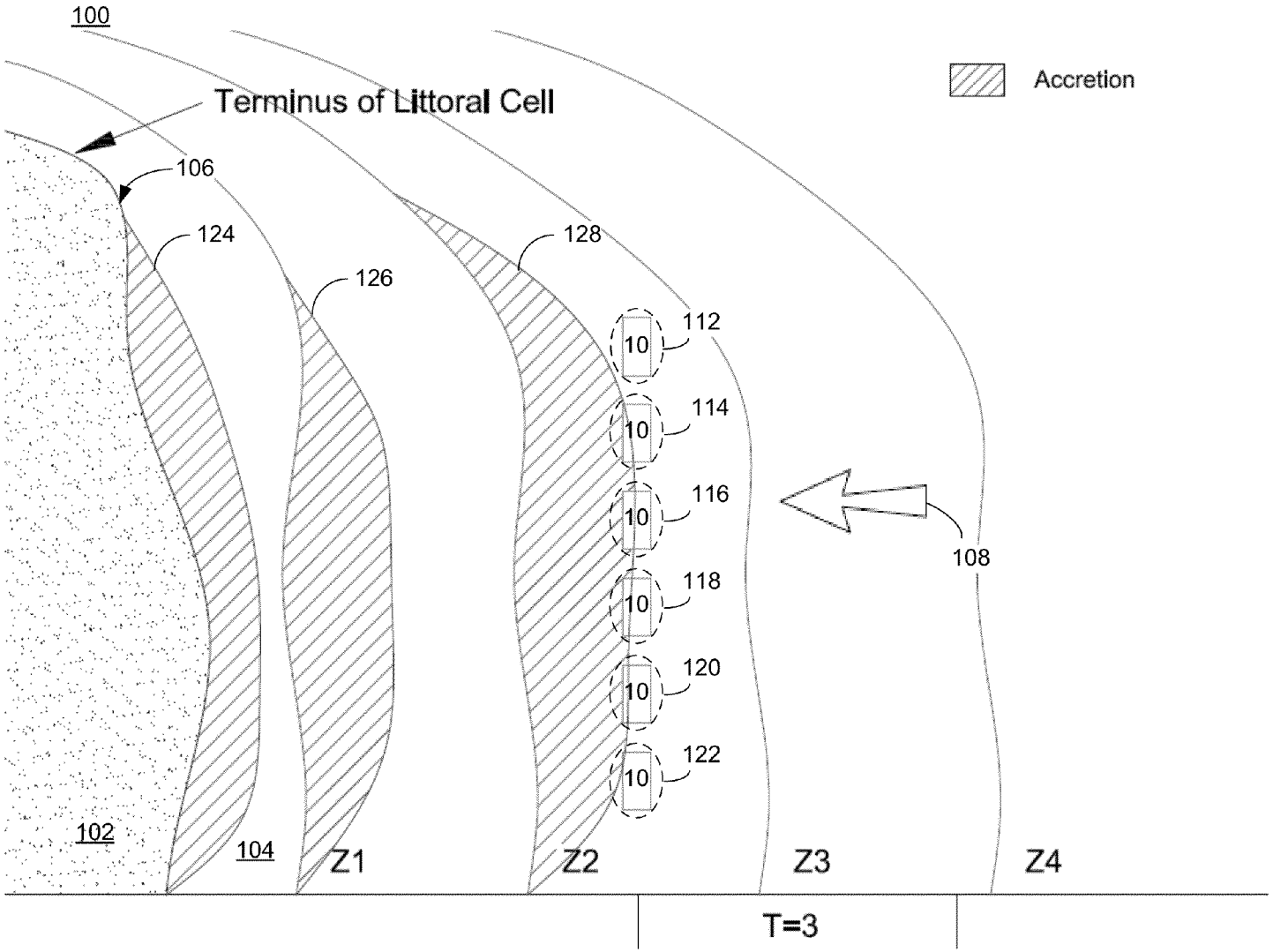
FIG. 17 diagrammatically depicts the formation of an accretion zone proximate to a plurality of recovery modules.

As discussed above, the one or more recovery modules may be removed 76 from the one or more first locations upon achieving a desired level of accretion (e.g., in a near-shore region in the illustrated example) relative to the one or more recovery modules. Referring to FIGS. 16 and 17, accretion may occur in the region between the one or more recovery modules (e.g., recovery modules 10) and beach 102. As the one or more recovery modules may disrupt and/or dissipate the energy of onshore current 108 prior to waves, etc., reaching beach to sea interface 106, the capacity of the water to suspend particulate material may be decrease. As the water may suspend less particulate material, there may be less particulate material carried away by the longshore current, and therefore less longshore drift erosion from the region of beach to sea interface 106 protected by the one or more recovery modules. However, the near-shore region relative to the one or more recovery modules may accrete, for example, due to the import of particulate material via longshore drift from updrift locations. Once sediment is transported into the near-shore region relative to the one or more recovery modules, the reduced capability of the water to suspend sediment (e.g., due to the disruption and/or dissipation of energy of onshore current 108) may prevent the sediment from subsequently being removed from the near-shore region relative to the one or more recovery modules.

Consistent with the foregoing, one or more accretion zones (e.g., accretion zones 124, 126, 128) may form in the near-shore region associated with the one or more recovery modules. The one or more accretion zones may result in a decrease in the depth of water in the near-shore region relative to the one or more recovery modules. The reduced water depth in the near-shore region relative to the one or more recovery modules may further result in a disruption and/or dissipation of the energy of onshore current 108 in the near-shore region. For example, the reduced water depth may additionally cause waves to break farther away from beach to sea interface 106, thereby creating a less energetic onshore current in the near-shore region. Once the desired level of accretion has been achieved in the near-shore region relative to the one or more recovery modules, the one or more recovery modules (e.g., one or more of recovery modules 10) may be removed 76 from the one or more first locations (e.g., one or more of first location 112, 114, 16, 118, 120, 122). Accordingly, the placement of the one or more recovery modules may facilitate coastal recovery, and once a desired level of coastal recovery has occurred, the one or more recovery modules may be removed from the one or more first locations, thereby leaving nothing behind. As described above, the reduction in depth of the water in the near-shore region relative to the one or more recovery modules may result in a reduction in the energy of onshore current 108 in the accreted near-shore region, even once the one or more recovery modules have been removed 76.

Removing 76 the one or more recovery modules may be accomplished using any suitable technique, for example, any of the techniques discussed with respect to positioning 72 the one or more recovery modules. For example, the one or more recovery modules (e.g., recovery modules 10) may be floated, and pushed or pull from the first location (e.g., by a workboat or other vessel). Similarly, the one or more recovery modules may be craned from the seafloor and loaded onto a barge or other vessel, or removed 76 via any other suitable techniques. In an embodiment in which positioning 72 the one or more recovery modules included ballasting 82 the one or more recovery modules, removing 76 the one or more recovery modules may include at least partially de-ballasting 88 the one or more recovery modules. For example, in an embodiment in which the one or more recovery modules may have been at least partially filled 84 with water, the one or more recovery modules may be blown down and/or pumped out, as described above with respect to FIGS. 7*b*-7*c*. In the event that ballast other than water may have been used, such ballast material may be removed using any suitable technique. Additionally, removing 65 the one or more recovery modules may include removing any anchors and/or spuds that may have been used.

While positioning 72 the one or more recovery modules (e.g., recovery modules 10) in one or more first locations (e.g., first locations 112, 114, 116, 118, 120, 122) may result in accretion in the near-shore region relative to the one or more recovery modules, without leaving behind any residual structures or components, in some cases it may be desirable to accomplish even greater coastal recovery. Such additional coastal recovery may be accomplished by moving the one or more recovery modules to one or more second positions. Accordingly, and referring also to FIGS. 18 and 19, in an embodiment the one or more recovery modules may be positioned 92 in one or more second locations (e.g., second locations 130, 132, 134, 136, 138, 140). The one or more second locations may be locations at which the one or more recovery modules may continue to disrupt and/or dissipate the energy of onshore current 108 (e.g., which may cause incoming waves to break prior to reaching beach to shore interface 106, and/or prior to reaching accretion zones 124, 126, 128).

Figure 18:
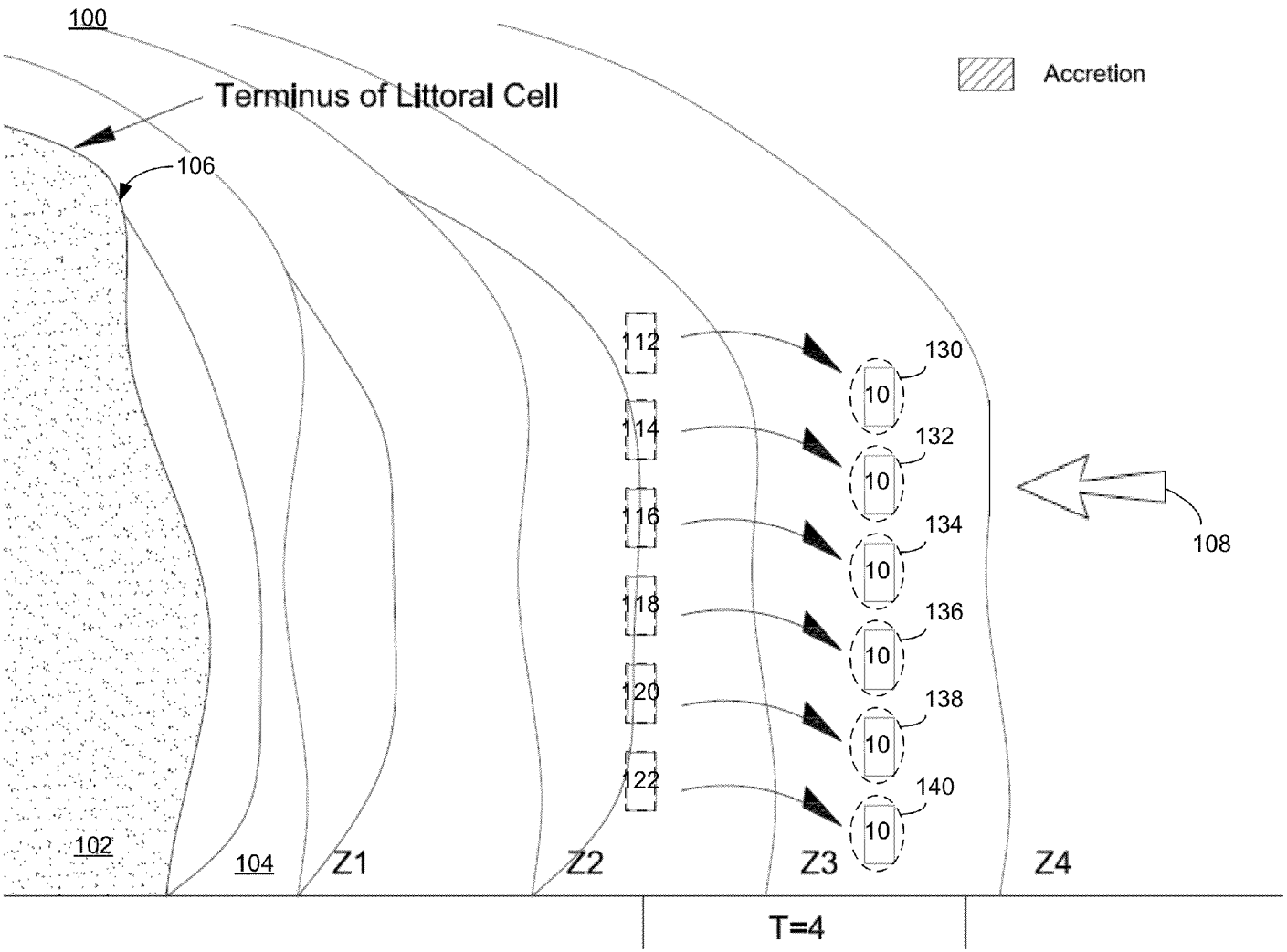
FIG. 18 diagrammatically depicts the plurality of recovery modules of FIG. 12 moved to a plurality of second locations.
Figure 19:
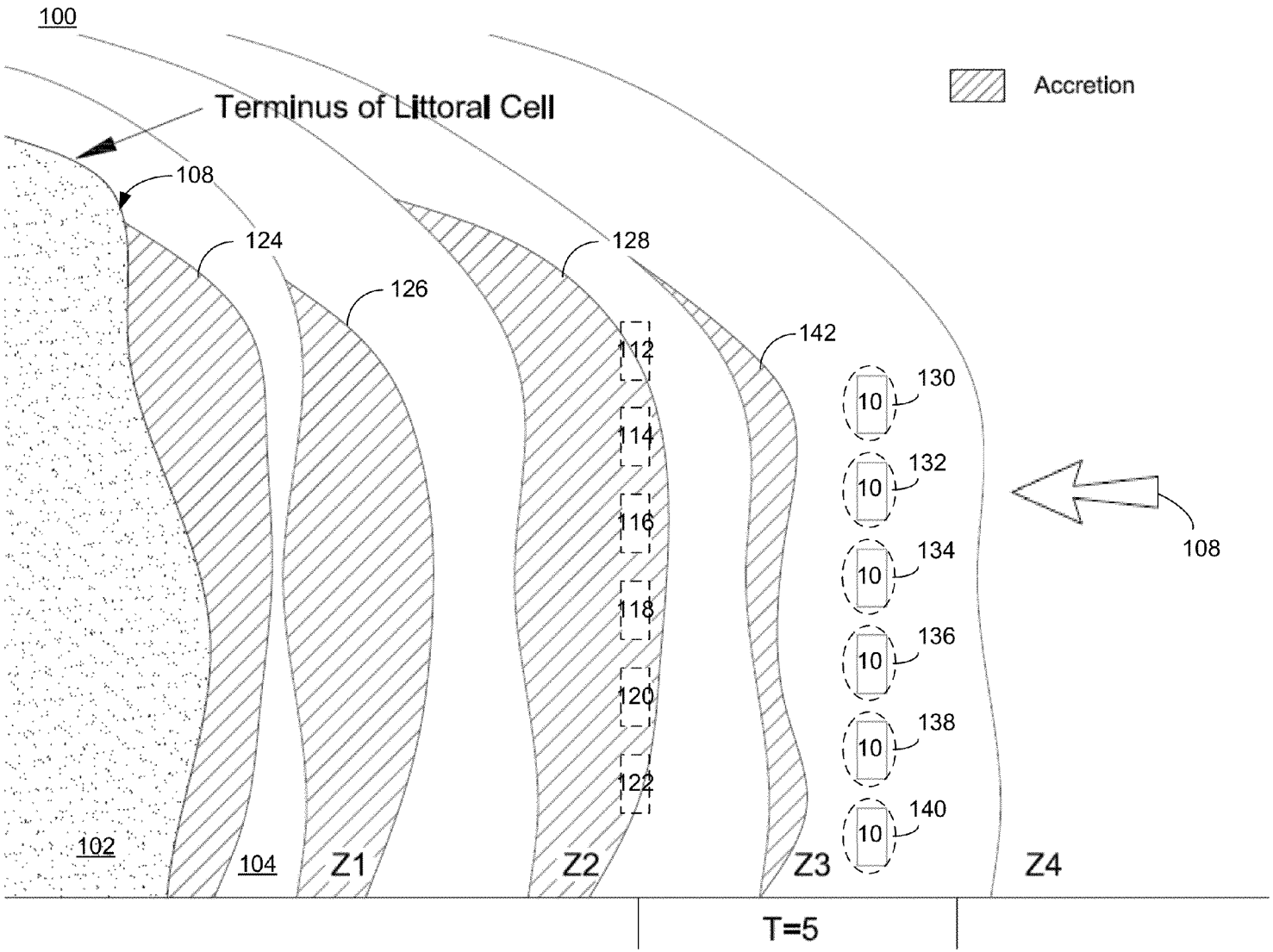
FIG. 19 diagrammatically depicts the formation of an accretion zone proximate to the plurality of recovery modules in the plurality of second locations.

Positioning 92 the one or more recovery modules (e.g., recovery modules 10) in the one or more second locations (e.g., second locations 130, 132, 134, 136, 138, 140) may include moving all, or at least a portion, of the one or more recovery modules to respective second locations. Consistent with the foregoing description, in which further coastal recovery is desired, the one or more recovery modules may be moved to the one or more second locations upon achieving a desired level of accretion in a near-shore region relative to at one of the first locations (e.g., first locations 112, 114, 116, 118, 120, 122). As shown in FIGS. 18 and 19, the one or more recovery modules may be moved by positioning the one or more recovery modules in one or more second locations (e.g., second locations 130, 132, 134, 136, 138, 140) that may include a seaward location relative to one or more of the first locations (e.g., first locations 112, 114, 116, 118, 120, 122). It should be noted that, for example, if the one or more first locations included a staggered arrangement (e.g., in which the longitudinal axes of a plurality of recovery modules were not collinear; not shown) one or more of the second locations may not be seaward of all of the first locations (e.g., a furthest inshore second location may not be seaward of a furthest seaward first location). Additionally/alternatively the one or more second locations (e.g., second locations 130, 132, 134, 136, 138, 140) may include an updrift location relative to one or more first locations. For example, because the one or more recovery modules may disrupt longshore drift (e.g., by reducing the energy of onshore current 108, and therein diminishing the ability of the water near beach to sea interface 106 to suspend sediment), positioning 92 the one or more recovery modules in an updrift location (e.g., with respect to the longshore current) may provide further beneficial coastal recovery. Positioning 92 the one or more recovery modules in the one or more second locations may be accomplished using any suitable technique, such as those techniques described above with respect to positioning 72 the one or more recovery modules in the one or more first locations. Further, similar to positioning 72 the one or more recovery modules in the one or more first locations, positioning 92 the one or more recovery modules in the one or more second locations may include orienting a longitudinal axis of the one or more recovery modules generally perpendicular to onshore current 108 (e.g., which may include orienting a longitudinal axis of the one or more recovery modules generally parallel to beach to sea interface 106).

Positioning 92 the one or more recovery modules in the one or more second locations may include sequentially moving the one or more recovery modules to a respective seaward and/or updrift location relative to the remaining recovery modules. Additionally/alternatively, positioning 92 the one or more recovery modules in the one or more second locations may include moving the one or more recovery modules at generally the same time (e.g., which may include moving the one or more recovery modules one at a time, but in relatively close temporal proximity). Various additional/alternative movement schemes may be implemented for positioning the one or more recovery modules in the one or more second locations.

With particular reference to FIG. 19, and similar to that shown and described with reference to FIGS. 16 and 17, accretion zones (e.g., accretion zones 124, 126, 128, and 142 shown in FIG. 19) may form in a near-shore region relative to the one or more recovery modules in the one or more second locations (e.g., second location 130, 132, 134, 136, 138, 140). The formation of accretion zones 124, 126, 128, and 142 may, for example, result from the disruption of longshore sedimentary drift as a result of the decreased energy of onshore current 108 in the region of beach to sea interface 106 and/or generally in the region between the one or more second locations and beach 102. For example, and as discussed above, the decrease in the energy of onshore current 108 caused by the one or more recovery modules may result in a decrease in the capacity for the water to suspend sediment, and thereby decrease the amount of sediment that can be carried away by the longshore current. However, sediment from an updrift location (e.g., at which the energy of onshore current 108 has not been decreased) may still migrate into the near-shore region between the one or more second locations and beach 102 on the longshore current.

According to one embodiment, once a desired level of restoration and/or stabilization has been accomplished (e.g., via accretion of sediment in a near-shore region relative to the one or more recovery modules), one or more recovery modules may be positioned 94 for ongoing maintenance and/or stabilization of the littoral cell 100. For example, one or more recovery modules may be positioned 94 in a maintenance location. The maintenance location may include, for example, one or more of the first locations (e.g., first locations 112, 114, 116, 118, 120, 122), one or more of the second locations (e.g., second locations 130, 132, 134, 136, 138, 140), and/or one or more third locations (not shown). As described herein, the one or more recovery modules positioned 94 in the one or more maintenance locations may be oriented generally perpendicular to onshore current 108, and/or generally parallel to beach to sea interface 106. Accordingly, the one or more recovery modules positioned 94 in the one or more maintenance locations may prevent/reduce erosion of the previously accreted sediment.

The one or more recovery modules positioned 94 in the one or more maintenance locations may remain in the one or more maintenance locations for a relatively extended period of time. For example, the one or more recovery modules may remain in the one or more maintenance locations for a single season (e.g., during which the onshore current may have a generally constant prevailing direction). Additionally/alternatively, the one or more recovery modules may remain in the one or more maintenance locations for one or more years (or any portion thereof). Not withstanding the relatively extended period of time that the one or more recovery modules may remain in the one or more maintenance locations, the one or more recovery modules may continue to be subject to relatively simple and complete removal.

As described above, recovery modules may be formed from a variety of materials. In the case of recovery modules positioned in maintenance locations, recovery modules may be formed from a material that is capable of withstanding prolonged exposure to water, for example salt water. For example, such recovery modules may be formed from concrete, e.g., which may be capable of withstanding such prolonged exposure to salt water. Additionally/alternatively, recovery modules positioned in maintenance locations may be formed from composite materials, polymeric materials, corrosion protected steel (e.g., including corrosion resistant coatings, and the like).

Consistent with any of the above-described movement techniques, positioning 92 the one or more recovery modules in one or more second locations may include moving all of the one or more recovery modules to one or more second locations. Additionally/alternatively, the one or more recovery modules may be moved in a sequential manner, e.g., in which only one recovery module may be moved at a time. Further, while only a single move of the recovery modules is shown (e.g., positioning 72 the one or more recovery modules in a first location and subsequently positioning 30 the one or more recovery modules in a second location), it will be appreciated that effecting a desired level of coastal recovery may include moving the one or more recovery modules to a plurality of seaward locations and/or a plurality of updrift locations within littoral cell 100. Additionally, the method may further include removing 90 at least a portion of the one or more recovery modules from the at least a portion of the second (or subsequent) locations. As discussed above, one aspect of the present disclosure may include a method to effect coastal recovery that does long leave any equipment or waste within the littoral cell once the desired coastal recovery has been accomplished. The one or more recovery modules may be removed utilizing any suitable techniques, including, but not limited to, the techniques described above.

As discussed with reference to FIG. 10, a method of coastal restoration and/or stabilization may generally include providing 70 a restoration module including a body portion defining an interior compartment, and a wave energy mitigation structure associated with at least a portion of a top surface of the body portion. Examples of recovery modules have been described hereinabove. The recovery module may be positioned 72 at a first location in a region relative to a beach to sea interface. A longitudinal axis of the recovery module may be oriented 74 generally perpendicular to a prevailing current. The recovery module may be removed 76 from the first location upon achieving a desired level of accretion relative to the recovery module. As used herein, coastal recovery and/or restoration may include coastal stabilization. Accordingly, the methods described herein may include methods for restoring a coastal region and/or for mitigating or reducing further erosion.

According to an example embodiment, and as generally discussed with reference to FIG. 11, littoral cell 100 may generally include a region of coastline encompassing a beach region 102 and a sea region 104, and defining beach to sea interface 106, generally (e.g., the surf zone). As is known, beach to sea interface 106 may be a dynamic region (e.g., rather than a static or defined line), and may shift as a result of tidal action (e.g., the beach to sea interface may be further landward during high tide and further seaward during low tide), wave action, and a variety of other dynamic environmental circumstances and effects. Longshore current 110 may have an overall direction that may be generally parallel to beach to sea interface 106. As is generally known, longshore current 110 may generally result from wind action causing waves to approach the beach at an angle other than perpendicular to beach to sea interface 106. The resultant swash may also generally be at an angle that is other than perpendicular to beach to sea interface 106. Sand, and other particulate material, may be transported up the beach generally in the direction of the swash. The backwash, or seaward current, of a receding wave may be generally perpendicular to beach to sea interface 106. As such, sand, and other particulate material, may be generally transported seaward in a direction that is generally perpendicular to the beach to sea interface. Because the swash and the backwash may be oriented differently relative to beach to sea interface 106, the resultant longshore current may result in sediment (e.g., sand and other particulate material) transport in the direction of longshore current 110.

Figure 20:
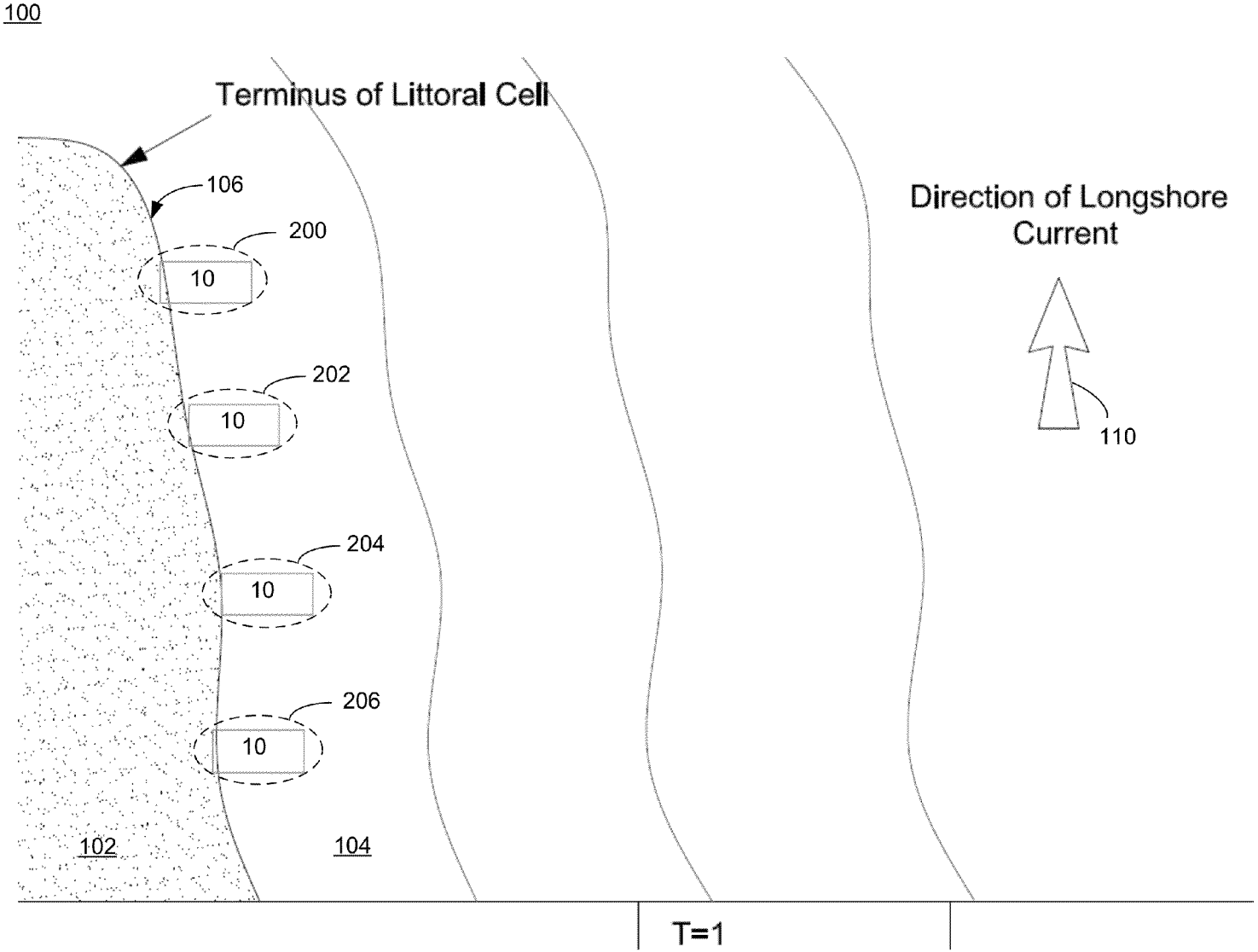
FIG. 20 diagrammatically depicts the portion of coastline of FIG. 11 including a plurality of recovery modules positioned relative thereto.

With reference also to FIG. 20, recovery module 10 may be positioned 72 at a first location (e.g., location 200) in a region of beach to sea interface 106. In addition/as an alternative to a single recovery module (e.g., recovery module 10), the method herein is equally susceptible to a plurality of recovery modules (e.g., recovery modules 10). In an implementation utilizing a plurality of recovery modules the plurality of recovery module may each be positioned 72 in a respective first location (e.g., respective location 200, 202, 204, 206) in a region of beach to sea interface 106, as shown in FIG. 20. It should be noted that while the figures herein may generally depict an implementation utilizing a plurality of recovery modules, the principles of the present disclosure are equally susceptible to the use of a single recovery module (e.g., recovery module 10). Further, while the figures herein generally depict an implementation utilizing four recovery modules, this is intended for the purpose of illustration only, as a greater or fewer number of recovery modules may be equally utilized. For example, depending upon the size of the littoral cell to be restored, twenty-four or more recovery modules may be utilized. As used herein, any characteristics, attributes, and operations described with respect to recovery module 10 may be equally attributable to any of the plurality of recovery modules (e.g., any of recovery modules 10). Further, the plurality of recovery modules may be generally analogous to one another (e.g., may include similar wave energy mitigation structures), and/or may differ from one another (e.g., one or more of the plurality of recovery modules may include a different wave energy mitigation structure than one or more other recovery modules of the plurality of recovery modules).

While recovery module 10 may be described herein as being positioned 72 in first location 200 (and/or locations 202, 204, 206) that may generally be in a downdrift region of littoral cell 100, this is intended for the purpose of explanation only (e.g., in the context of a specific embodiment of coastal recovery of a larger region of littoral cell 100, to be described in greater detail below), and should not be construed as a limitation. In various additional/alternative embodiments recovery module may be positioned 72 at any desired location within littoral cell 100, e.g., to effectuate localized coastal recovery, and or to effectuate coastal recovery of a larger region of littoral cell 100 in an alternatively sequenced manner. All such implementations are considered to be within the contemplation of this disclosure.

As shown, a longitudinal axis of recovery module 10 may be oriented 74 generally perpendicular to longshore current 110. Consistent with the present disclosure, the presence of the one or more recovery modules at beach to sea interface 106 may generally disrupt the longshore current in the region proximate the one or more recovery modules. The degree or disruption of the longshore current may be, at least in part, based upon the dimension of the recovery module generally perpendicular to the longshore current. As such, a longitudinal axis of recovery module 10 may be oriented 74 generally perpendicular to longshore current 110 to maximize the disruption of longshore current 110 in the region proximate recovery module 10. However, it should be appreciated that other orientations of the one or more recovery modules (including an orientation in which the longitudinal axis of the one or more recovery modules is generally parallel to the longshore current) may also be utilized with varying degrees of efficacy (e.g., which may be based upon, at least in part, the degree of resultant disruption of the longshore current).

Further, in some embodiments, the disruption and/or dissipation of at least a portion of the energy of longshore current 110 may be facilitated and/or enhanced by the wave energy mitigation features of recovery module 10. For example, the various wave energy mitigation features of recovery module 10 may disrupt the organized flow of longshore current 110, may impart destructive wave interference, and/or otherwise attenuate the energy of longshore current 110.

Positioning 72 the recovery module (e.g., recovery module 10 for the purpose of example) in the first location (e.g., location 200) may include positioning 78 the recovery module (e.g., recovery module 10) to be at least partially submerged and at least partially emergent during at least a portion of a tidal cycle. Positioning 72 recovery module 10 to be at least partially emergent during at least a portion of a tidal cycle may include positioning recovery module 10 such that at least a portion recovery module 10 is disposed above the average water level (e.g., the water level at a midpoint between the crest and trough of a wave) during at least a portion of a tidal cycle. In an at least partially emergent position, recovery module 10 may (but is not required to be) completely submerged during at least a portion of a tidal cycle (e.g., during high tide) and/or in above average seas for littoral cell 100.

Positioning 72 the recovery module (e.g., recovery module 10 for the purposed of example) in the first location (e.g., location 200) may include positioning 78 recovery module 10 to be at least partially submerged during at least a portion of a tidal cycle. Being positioned 78 to be at least partially submerged during at least a portion of a tidal cycle, at least a portion of recovery module 10 may be disposed below the average water level during at least a portion of a tidal cycle. In an at least partially submerged position, recovery module 10 may (but is not required to be) completely emergent during at least a portion of a tidal cycle (e.g., during low tide) and/or in below average seas for littoral cell 100.

Furthermore, positioning 72 the recovery module (e.g., recovery module 10) in the first location (e.g., location 200 of recovery module 10) may include positioning 72 at least about half of recovery module 10 in the sea. In such an arrangement recovery module 10 may be positioned 72 such that the full height of recovery module 10 is submerged for half of the length of recovery module 10 during at least a portion of a tidal cycle. For example, recovery module 10 may be positioned such that the full height of recovery module 10 is below the average water level at a mid-tide condition (e.g., a tide level that is midway between high tide water level and low tide water level) for half of the length of recovery module 10. Accordingly, recovery module 10 may bridge beach to sea interface 106 during at least a portion of a tidal cycle. In such a configuration, the waterline may generally move up and down the length of recovery module 10 during a tidal cycle.

Positioning 72 the one or more recovery modules (e.g., recovery modules 10) may include ballasting 82 the one or more recovery modules. As discussed above, the one or more recovery modules may include an interior compartment. In some embodiments, the interior compartment of the one or more recovery modules may be, at least initially, emptied during positioning 72. For example, when the interior compartment of a recovery module is empty, the weight of the recovery module may be decrease, thereby facilitating moving the recovery module. Once the recovery module has been positioned 72 in the desired location, the recovery module may be ballasted 82, for example, which may increase the weight and stability of the recovery module. Accordingly, once the recovery module has been ballasted 82, the recovery module may be less susceptible to undesired movement, e.g., due to the wind or wave. However, it is also appreciated that the strata of the beach and/or sea floor may vary in consistency and stability, which may give rise to settling of the recovery module. Therefore, the degree of ballasting may be determined, at least in part, by the nature of the beach and/or sea floor strata such that undue settling may be reduce and/or eliminated. Undue settling, as used herein, may include settling that may inhibit and/or undesirably increase the difficulty of future repositioning and/or removal of the recovery module; settling that may alter the degree of emergence of the recovery module and undesirably reduce inhibition of longshore drift or otherwise decrease the efficacy of the recovery module; or otherwise give rise to undesirable movement of the recovery module. The degree of ballasting may be varied by the selection of ballasting materials, the amount of ballasting material, the inclusion of low density materials (e.g., foam materials, air bladders, or other low density materials), and the like. In addition, baffling may be used in conjunction with, or exclusive of the aforementioned ballasting materials, to minimize, mitigate or otherwise eliminate undesired settlement of the recovery modules.

In one embodiment, the recovery module may be ballasted 82 by at least partially filling 84 the recovery module with water. The recovery module may be at least partially filled 84 with water by, for example, pumping water into the recovery module, opening one or more seacocks below the water level (e.g., an possibly also one or more air vents above the water level), thereby allowing the recovery module to at least partially flood. In addition/as an alternative to at least partially filling the recovery module with water, other ballasting materials (e.g., sand, rocks, etc.) may be similarly utilized. Further, in addition/as an alternative to ballasting 82 the recovery module, positioning 72 the recovery module in first location 200 may include anchoring 86 the recovery module in place. The recovery module may be anchored 86 using any suitable known anchor, such as a mushroom anchor, earth auger, etc. Similarly, the recovering module may be anchored 86 by spudding. As described hereinabove, a spud may generally include a vertical post (such as a steel rod, shaft, or tubular member) that may be coupled to the recovery module (e.g., as by being received through a receptacle or opening in the recovery module and/or attached to the recovery module) and may be at least partially driven into the beach and/or sea floor.

Figure 21:
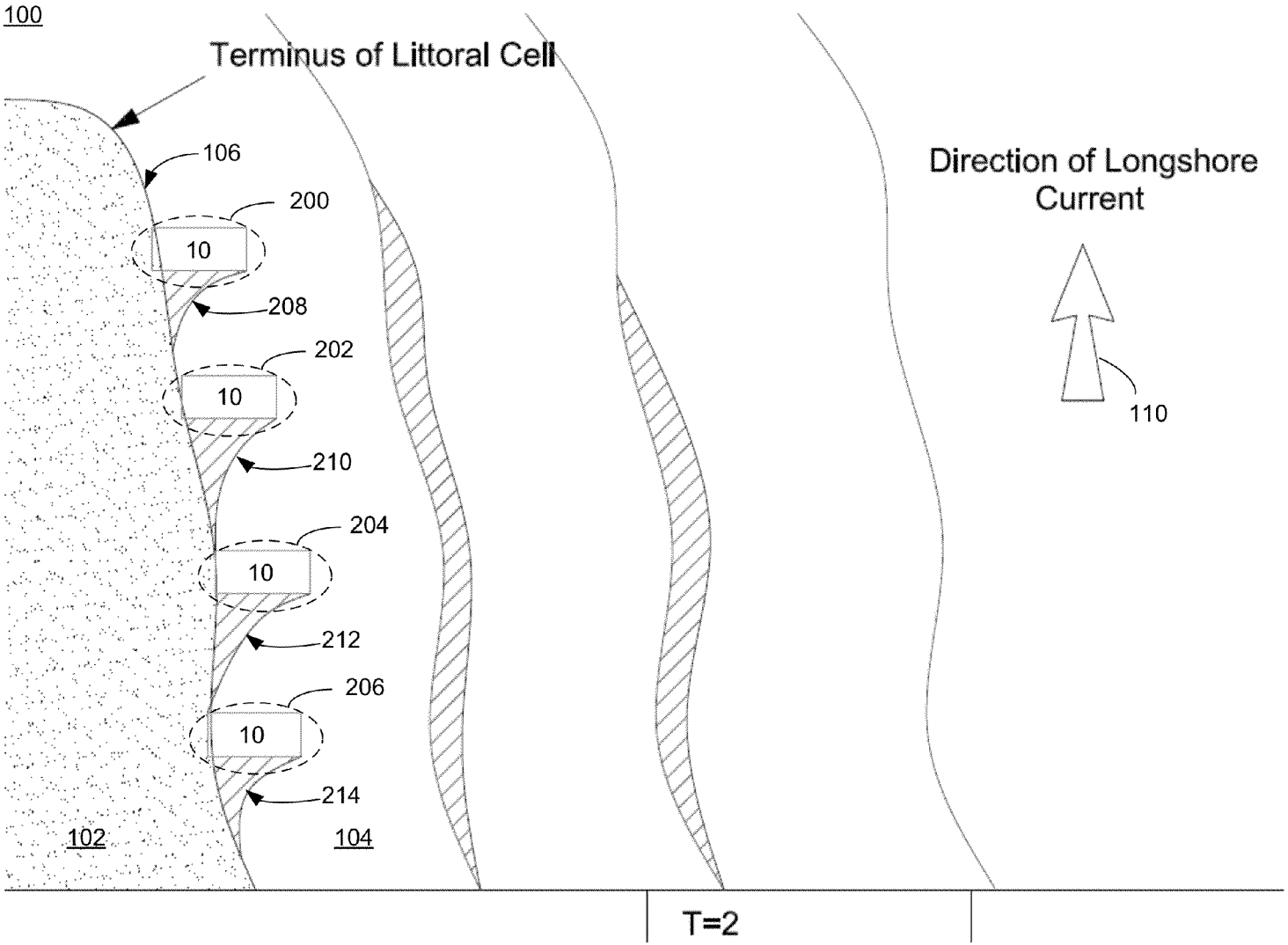
FIG. 21 diagrammatically depicts the formation of an accretion zone proximate to a plurality of recovery modules.

As discussed briefly above, the one or more recovery modules (e.g., recovery modules 10) may be removed 76 from the first location (e.g., respective first location 200, 202, 204, 206) upon achieving a desired level of accretion adjacent to the recovery module. For example, and referring also to FIGS. 21 and 22, recovery modules 10 located at beach to sea interface 106 (e.g., at respective locations 200, 202, 204, 206) may disrupt longshore current 110 in the region of respective recovery modules 10. The disruption of longshore current 110 may cause sediment to accrete on the updrift side of the one or more recovery modules. For example, sediment (e.g., sand and other particulate material) may be carried in a downdrift direction. However, upon reaching a recovery module (e.g., recovery modules 10) the sediment may not be able to continue to migrate in the downdrift direction (e.g., which may be a result of the physical obstruction caused by the recovery module, a loss of energy in the downdrift direction sufficient to carry and/or suspend the sediment, etc.). As a result of the disruption of longshore current 110, accretion zones (e.g., accretion zones 208, 210, 212, 214) may form around the one or more recovery modules (e.g., respective recovery modules 10 shown in FIGS. 21 and 22). Once a desired level of accretion has occurred adjacent the one or more recovery modules, the one or more recovery modules may be removed 76 from the first location (e.g., respective first locations 200, 202, 204, 206). Accordingly, the placement of the recovery modules may facilitate coastal recovery, and once a desired level of coastal recovery has occurred, the recovery modules may be removed from the first location, thereby leaving nothing behind. As described above, the desired level of accretion may provide a reduced longshore current interaction at the recovery module (e.g., as a result, at least in part, of the built up accretion zones 208, 210, 212, 214).

Figure 22:
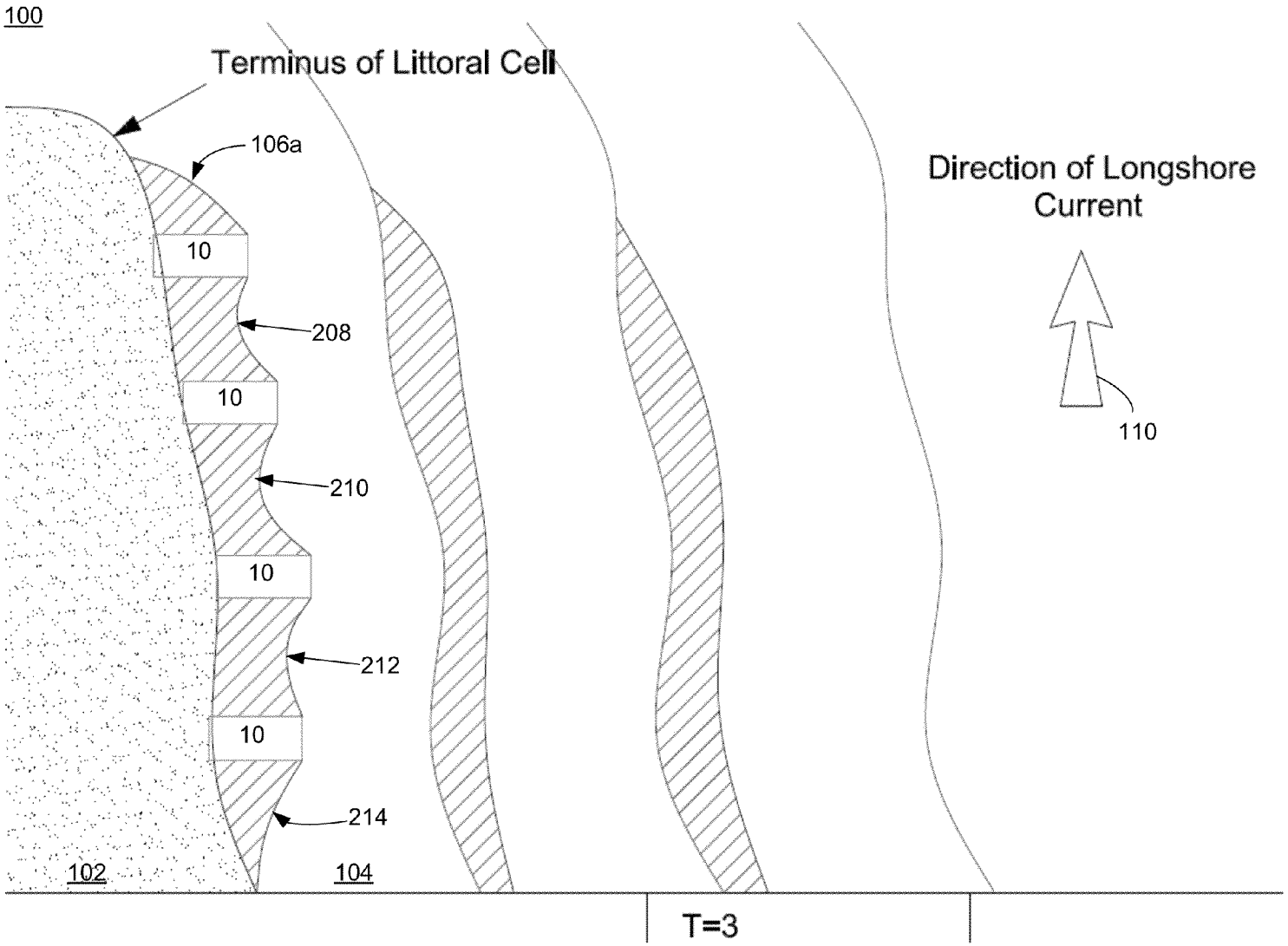
FIG. 22 diagrammatically depicts the formation of an accretion zone proximate to a plurality of recovery modules.

In some embodiments, for example, as shown in FIG. 22, as the beach accretes around the one or more recovery modules (e.g., recovery modules 10), the one or more recovery module may become progressively more emergent (i.e., a greater amount of the recovery modules 10 may become high and dry). At this stage, the recovery modules may be completely on beach 102 during at least a portion of a tidal cycle. Once the accretion zones extend the full length of respective recovery modules, no further accretion may occur as a result of the presence of the recovery modules. Accordingly, at such the recovery modules may be removed 76 from beach 102. While, consistent with this example, it may be possible to build up accretion zones 208, 210, 212, 214 until recovery modules 10 are completely on beach 102 (i.e., the accretion zones extend the entire length of the recovery modules) it is not necessary to achieve such a level of accretion.

As discussed above, once a desired level of accretion has been achieved adjacent the one or more recovery modules (e.g., recovery modules 10) in the one or more respective first locations (e.g., respective first locations 200, 202, 204, 206), the one or more recovery modules may be removed 76 from the first locations. Any suitable technique, or combination of techniques, may be used for removing 76 the one or more recovery modules. For example, the one or more recovery modules (e.g., recovery modules 10) may be removed 76 utilizing techniques similar to the techniques utilized for positioning 72 recovery module, described with reference to FIGS. 13 through 15. Further, removing 76 the recovery module may include at least partially de-ballasting 88 the recovery module. For example, if recovery module 10 was ballasted 82 by being at least partially filled 84 with water, the water may be pumped out of recovery module 10, drained from recovery module 10 (e.g., by opening one or more seacocks included on recovery module 10), by displacing the water (e.g., by pumping compressed air into recovery module 10), or other suitable means, e.g., as generally described with reference to FIGS. 7*a* through 7*c*, above. Similarly, if recovery module 10 was ballasted 82 with sand or rock, the sand or rocks may be removed, e.g., using an excavator, or similar technique. Additionally, removing 76 the one or more recovery modules may include removing any anchors associated with the one or more recovery modules.

Figure 23:
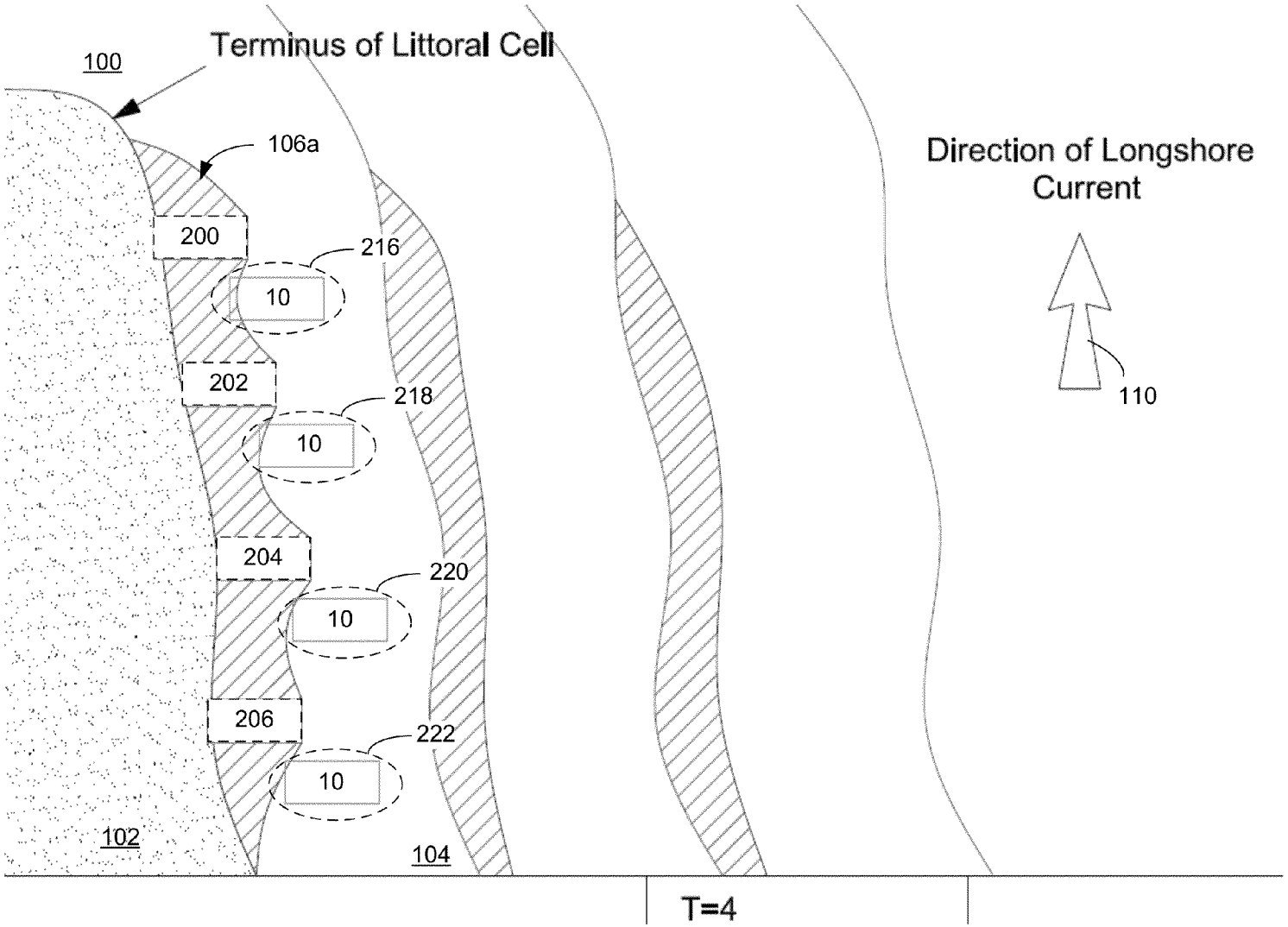
FIG. 23 diagrammatically depicts the plurality of recovery modules of FIG. 20 moved to a plurality of second locations.

Consistent with the foregoing description, coastal recovery may be accomplished, at least in part, through accretion adjacent to one or more recovery modules in the one or more first locations. Once a desired level of accretion has been achieved, the one or more recovery modules may be removed from the first locations. As such, coastal recovery may be achieved with not residual structures or components remaining behind once the coastal recovery has been achieved. In some implementations, additional coastal recovery, beyond the accretion adjacent to the first locations, may be desired. Referring also to FIG. 23, additional coastal recovery may be accomplished by positioning 92 one or more recovery modules at one or more second locations (e.g., second locations 216, 218, 220, 222) in a region of beach to sea interface 106*a*. It should be noted that, due to accretion resulting from positioning 72 the one or more recovery modules (e.g., recovery modules 10) in the one or more first locations (e.g., first location 200, 202, 204, 206) the location of a beach to sea interface 106*a* may have migrated seaward, relative to the initial location of beach to sea interface. The one or more recovery modules (e.g., recovery modules 10) may be moved from the first location (e.g., first locations 200, 202, 204, 206) to the one or more second locations (e.g., second locations 216, 218, 220, 222) utilizing any suitable techniques, including but not limited to the techniques shown and described with reference to FIGS. 13 through 15.

The second location (e.g., one or more for second locations 216, 218, 220, 222) may include an updrift location relative to the first location. For example, as shown in FIG. 23, second location 216 may include a location that is at least partially in an updrift (e.g., moved in an up-current direction of longshore current 110) relative to first location 200. Similarly, in an implementation utilizing a plurality of recovery modules, one or more of the second positions associated with one or more of the plurality of restorations may include an updrift location relative to the respective first locations of the plurality of recovery modules.

Further, while not shown, in one embodiment, a plurality of recovery modules may be migrated in an updrift location utilizing a "leap frog" type technique. For example, as shown in FIG. 23, positioning 92 the plurality of recovery modules in a plurality of second locations that each include an updrift location relative to the respective first locations of each of the plurality of recovery modules. For example, the at least one second location may include an updrift location relative to the plurality of first locations. Further, consistent with an embodiment of a leap frog technique, the at least one of the plurality of recovery modules may include a furthest downdrift recovery module of the plurality of recovery modules. For example, a second location associated with recovery module 10 (e.g., which may be a further downdrift recovery module of the plurality of recovery modules) may include an updrift location relative to first location 206 associated with the furthest updrift recovery module of the plurality of recovery modules in the first locations. The others of the plurality of recovery modules may be sequentially moved to an updrift location relative to the remaining recovery modules in a corresponding leap frog manner. Consistent with such a leap frog migration technique, the plurality of recovery modules may be moved sequentially, en masse, or utilizing other migration schemes.

Figure 24:
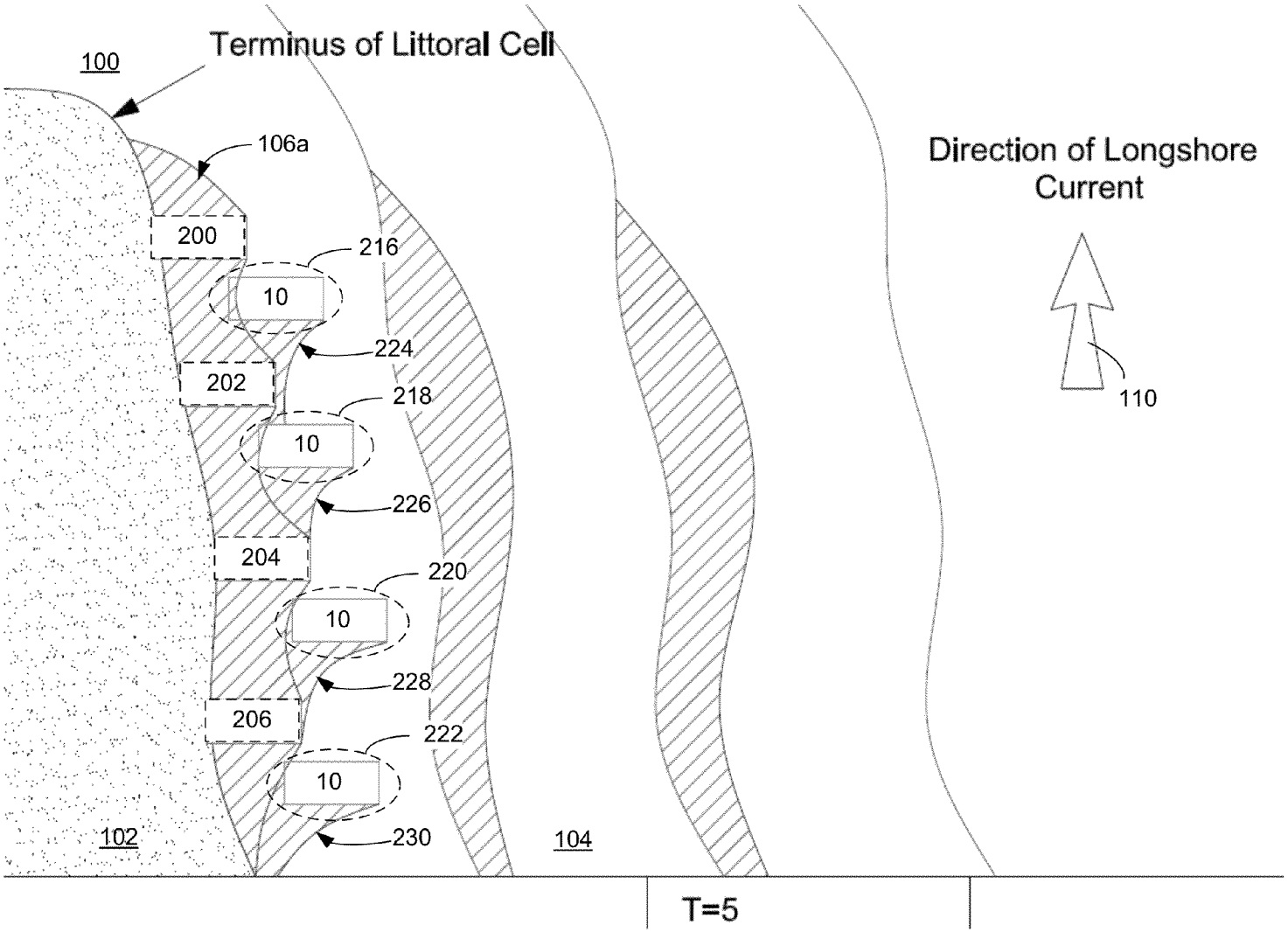
FIG. 24 diagrammatically depicts the formation of an accretion zone proximate to the plurality of recovery modules in the plurality of second locations.

With reference again to FIG. 23, in addition/as an alternative to positioning 92 the one or more recovery modules in a second location that includes an updrift location, the second location may include a seaward location relative to the first location. For example, as shown in FIG. 23, second locations 216, 218, 220, 222 may include seaward locations relative to respective first locations 200, 202, 204, 206. As described above, accretion zones 208, 210, 212, 214 may form adjacent respective recovery modules. As such, the effective beach to sea interface (e.g., beach to sea interface 106*a*) may migrate seaward as beach 102 is restored. As such, the first locations (e.g., first locations 200, 202, 204, 206) may be up the beach relative to the beach to sea interface due to the accumulation of accretion zones 208, 210, 212, 214. Second locations 216, 218, 220, 222, which may include seaward locations relative to the first locations, may once again position 92 the one or more recovery modules in the new beach to sea interface (e.g., beach to sea interface 106*a*) such that the one or more recovery modules may be generally half in the water and half in the sea, as described above with respect to positioning 72 the one or more recovery modules in the one or more first locations. Referring also to FIG. 24, and as shown and described with reference to FIGS. 21 and 22, accretion zones (e.g., accretion zones 224, 226, 228, 230 shown in FIG. 24) may form adjacent to the one or more recovery modules (e.g., recovery modules 10) as a result of longshore drift caused by longshore current 110.

According to one embodiment, once a desired level of restoration and/or stabilization has been accomplished (e.g., via accretion of sediment adjacent the one or more recovery modules), one or more recovery modules may be positioned for ongoing maintenance and/or stabilization of the littoral cell 100. For example, one or more recovery modules may be positioned 94 in a maintenance location. The maintenance location may include, for example, one or more of the first locations (e.g., first locations 200, 202, 204, 206), one or more of the second locations (e.g., second locations 216, 218, 220, 222), and/or one or more third locations (not shown). As described herein, the one or more recovery modules positioned 94 in the one or more maintenance locations may be oriented generally perpendicular to longshore current 110. Accordingly, the one or more recovery modules positioned 94 in the one or more maintenance locations may prevent/reduce erosion of the previously accreted sediment.

The one or more recovery modules positioned 94 in the one or more maintenance locations may remain in the one or more maintenance locations for a relatively extended period of time. For example, the one or more recovery modules may remain in the one or more maintenance locations for a single season (e.g., during which the longshore current may have a generally constant direction). Additionally/alternatively, the one or more recovery modules may remain in the one or more maintenance locations for one or more years (or any portion thereof). Not withstanding the relatively extended period of time that the one or more recovery modules may remain in the one or more maintenance locations, the one or more recovery modules may continue to be subject to relatively simple and complete removal.

As described above, recovery modules may be formed from a variety of materials. In the case of recovery modules positioned in maintenance locations, recovery modules may be formed from a material that is capable of withstanding prolonged exposure to water, for example salt water. For example, such recovery modules may be formed from concrete, e.g., which may be capable of withstanding such prolonged exposure to salt water. Additionally/alternatively, recovery modules positioned in maintenance locations may be formed from composite materials, polymeric materials, corrosion protected steel (e.g., including corrosion resistant coatings, and the like).

According to another embodiment, in addition to restoring a coastal region, accreted sediment may be used to form on shore protective barriers. For example, accreted sediment may be moved (e.g., from one or more of accretion zones 208, 210, 212, 214, 224, 226, 228, 230) to create on shore features such as dunes, berms, and/or other permanent, long term, and/or sacrificial barriers to guard against major storms. Such features may protect further inland portions of the coastal region, e.g., in the even of a relatively large storm. Sediment may be moved from one or more of the accretions zones in a generally conventional manner, e.g., slurry pumping; heavy equipment, such as bulldozers, loaders, and the like; as well as any variety of other suitable techniques.

Consistent with any of the above-described movement techniques, positioning 92 at least one of the recovery modules in a second location may include moving all of the plurality of recovery modules to a plurality of second locations (e.g., moving the plurality of recovery modules en masse). Additionally/alternatively, the one or more recovery modules may be moved in a sequential manner, e.g., in which only one recovery module may be moved at a time. Further, while only a single move of the recovery modules is shown (e.g., positioning 72 the one or more recovery modules in a first position and subsequently positioning 92 the one or more recovery modules in a second position), it will be appreciated that effecting a desired level of coastal recovery may include moving the one or more recovery modules to a plurality of updrift locations and/or a plurality of seaward locations within littoral cell 100. Additionally, the method may further include removing 90 at least a portion of the plurality of recovery modules from the region of the beach to sea interface. As discussed above, one aspect of the present disclosure may include a method to effect coastal recovery that does long leave any equipment or waste within the littoral cell once the desired coastal recovery has been accomplished. The one or more recovery modules may be removed utilizing any suitable techniques, including, but not limited to, the techniques shown and described with reference to FIGS. 13 through 15.

Figure 25:
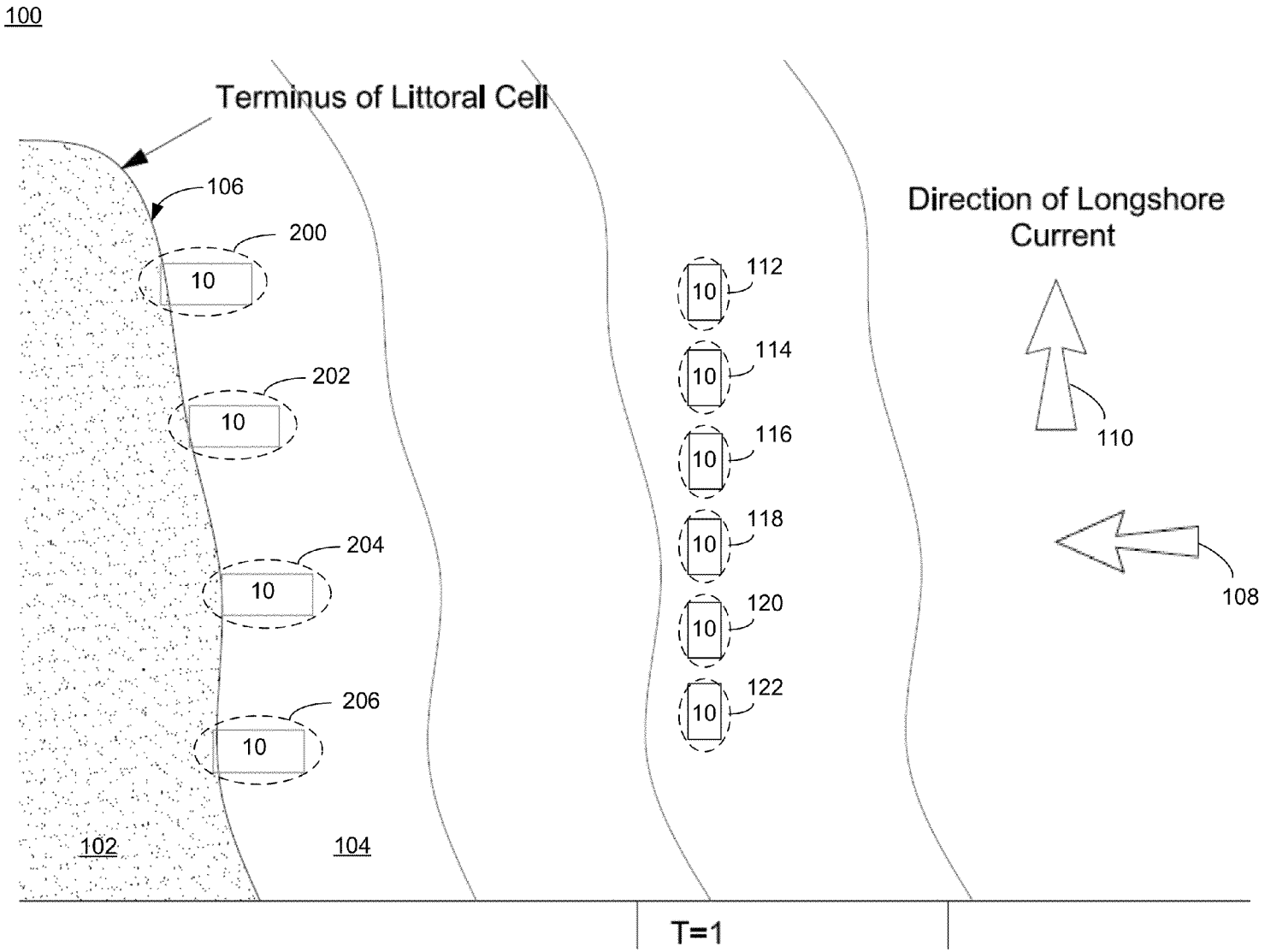
FIG. 25 diagrammatically depicts the portion of coastline of FIG. 11 including a plurality of recovery module positioned relative thereto.
Figure 26:
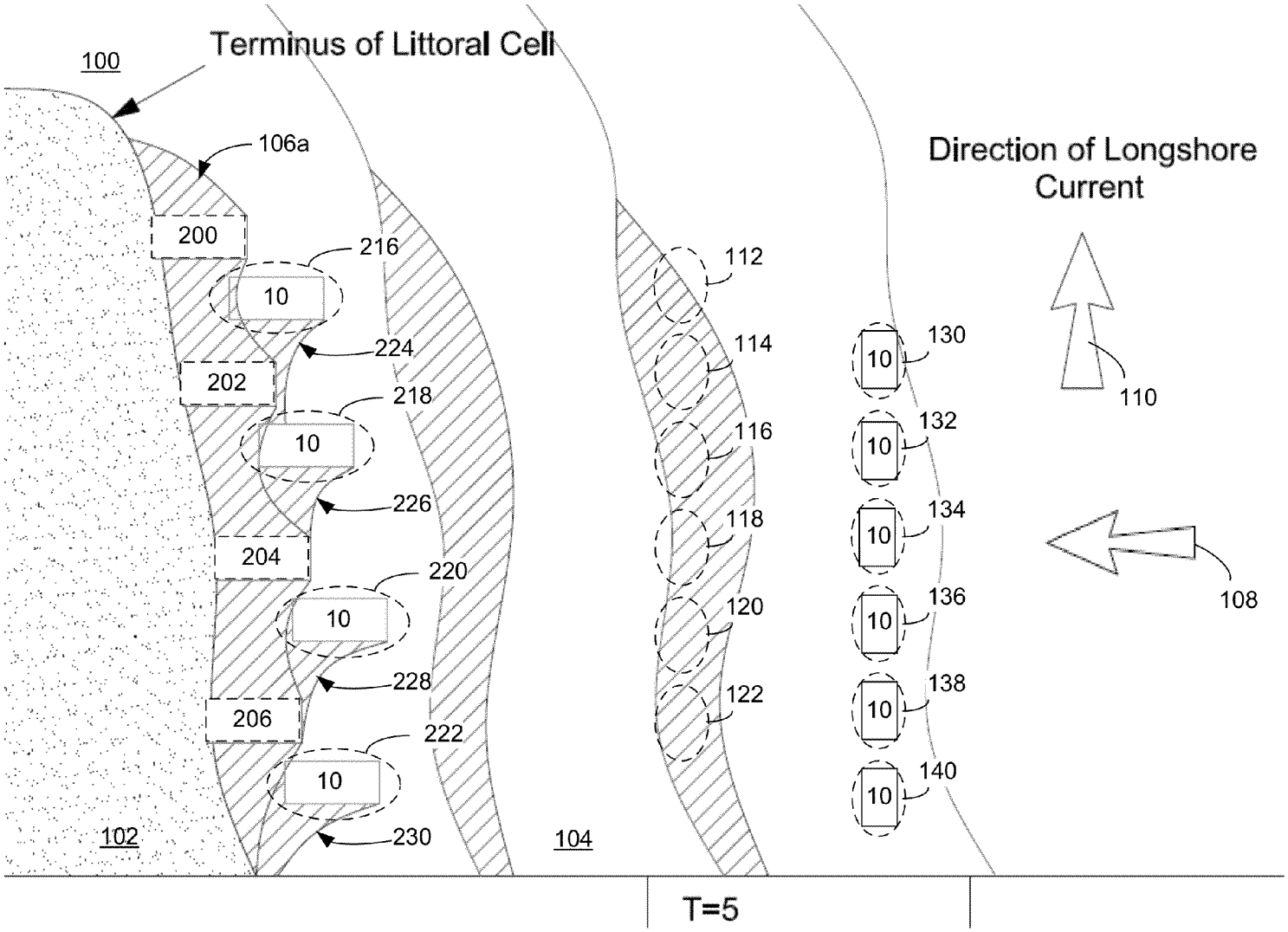
FIG. 26 diagrammatically depicts the plurality of recovery modules of FIG. 25 moved to a plurality of second locations.

Referring also to FIG. 25 and FIG. 26, according to an example embodiment, and as discussed with reference to FIG. 10, a method of coastal restoration and/or stabilization may generally include providing 70 a restoration module including a body portion defining an interior compartment, and a wave energy mitigation structure associated with at least a portion of a top surface of the body portion. Examples of recovery modules have been described hereinabove. The recovery module may be positioned 72 at a first location in a region relative to a beach to sea interface. Further, a longitudinal axis of the recovery module may be oriented 74 generally perpendicular to a prevailing current. As shown in FIG. 25, in an embodiment, at least one recovery module may be positioned 72 in a first location 112, such that a longitudinal axis of the recover module in first position 112 may be oriented 74 generally perpendicular to onshore current 108. Further, at least one recovery module may be positioned in a first location 100, such that a longitudinal axis of the recovery module in first location 200 may be oriented 74 generally perpendicular to longshore current 110. As shown, in some embodiments, a plurality of recovery module may be positioned 72 in a plurality of first locations (e.g., first locations 112, 114, 116, 118, 120, 122) having a longitudinal axis oriented generally perpendicular to onshore current 108. Further, as shown, in some embodiments, a plurality of recovery modules may also be positioned 72 in a plurality of first locations (e.g., first locations 200, 202, 204, 206) having a longitudinal axis oriented 74 perpendicular relative to longshore current 110.

The one or more recovery modules having a longitudinal axis oriented generally perpendicular to onshore current 108 (i.e., the plurality of recovery modules in the plurality of first locations 112, 114, 116, 118, 120, 122) may disrupt and/or otherwise mitigate onshore current 108, in a manner as generally described with respect to FIGS. 12-19. The one or more recovery modules having a longitudinal axis oriented generally perpendicular to longshore current 110 (i.e., the plurality of recovery modules in the plurality of first locations 200, 202, 204, 206) may disrupt and/or otherwise mitigate longshore current 110, as generally described with respect to FIGS. 20-24. As shown with respect to FIG. 26, one or more of the plurality of recovery modules may be positioned in one or more second locations (e.g., one or more of second locations 130, 132, 134, 136, 138, 140, 216, 218, 220, 222) in a manner as also generally described with respect to FIGS. 12-24.

According to various embodiments, the collocation, within a common littoral cell (e.g., littoral cell 100), of one or more recovery modules having a longitudinal axis oriented generally perpendicular to onshore current 108 and one or more recovery modules having a longitudinal axis oriented generally perpendicular to longshore current 110 may provide a generally synergistic relationship. In such an embodiment, the coastal recovery results (e.g., stabilization of a coastline and/or accumulation of accretion zones, etc.) may be greater than may typically be experienced in an embodiment in which recovery modules may be only oriented perpendicular to the onshore current or only perpendicular to the longshore current. For example, the combined effects of a disrupted and/or mitigated onshore current along with a disrupted and/or mitigated longshore current may work together to decrease the suspension of sediment (e.g., the carrying capacity) of onshore waves and also decrease the transport of any suspended sediment by the longshore current. As such, stabilization of the coastline and/or accumulation of accretion zones may be greatly increased.

A number of implementations have been described. Nevertheless, it will be understood that various modifications may be made. Accordingly, other implementations are within the scope of the following claims.

What is claimed is:

1. A coastal recovery module comprising:

a body portion defining an interior compartment;

a selectively sealable fluid conduit providing a fluid communication between the interior compartment and an exterior of the body portion, the fluid conduit configured for selectively flooding and dewatering the interior compartment; and a wave energy mitigation structure associated with at least a portion of a top surface of the body portion, wherein the wave energy mitigation structure includes a plurality of generally L-shaped members extending from the top surface of the body portion.

2. The coastal recovery module according to claim 1, wherein the plurality of generally L-shaped members are oriented in a generally parallel configuration.

3. The coastal recovery module according to claim 1, wherein at least a portion of the plurality of generally L-shaped members are oriented at an angle relative to one another.

4. The coastal recovery module according to claim 1, wherein the fluid conduit includes an opening adjacent a top of the body portion, and a conduit providing fluid communication between the opening and a portion of the interior compartment adjacent a bottom region of the interior compartment.

5. The coastal recovery module according to claim 1, further including a spud receptacle coupled with the body portion.

6. The coastal recovery module according to claim 1, further including one or more rib members within the interior compartment.

* * * * *